US010473102B2

(12) United States Patent
Lee et al.

(10) Patent No.: US 10,473,102 B2
(45) Date of Patent: Nov. 12, 2019

(54) ROTARY COMPRESSOR HAVING FLUID PASSAGE BETWEEN SLIDING VANE AND VANE SLOT

(71) Applicant: LG ELECTRONICS INC., Seoul (KR)

(72) Inventors: Yunhi Lee, Seoul (KR); Seoungmin Kang, Seoul (KR); Jinung Shin, Seoul (KR); Seokhwan Moon, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 288 days.

(21) Appl. No.: 15/417,486

(22) Filed: Jan. 27, 2017

(65) Prior Publication Data

US 2017/0218956 A1 Aug. 3, 2017

(30) Foreign Application Priority Data

Feb. 2, 2016 (KR) ..... 10-2016-0013067
Feb. 2, 2016 (KR) ..... 10-2016-0013071

(51) Int. Cl.
*F04C 18/356* (2006.01)
*F01C 21/08* (2006.01)
(Continued)

(52) U.S. Cl.
CPC ..... *F04C 18/3568* (2013.01); *F01C 21/0809* (2013.01); *F04C 18/3566* (2013.01);
(Continued)

(58) Field of Classification Search
CPC ..... F01C 21/0809; F04C 18/3566; F04C 29/0085; F04C 18/3564; F04C 18/3568; F04C 18/356; F04C 18/3562
(Continued)

(56) References Cited

U.S. PATENT DOCUMENTS 3,139,036 A * 6/1964 McGill ..... F01C 21/0863 418/248
4,599,058 A * 7/1986 Stone ..... F01C 21/0809 418/221
(Continued)

FOREIGN PATENT DOCUMENTS

CN 102788019 11/2012
JP 63189683 A * 8/1988 ..... F01C 21/0809
(Continued)

OTHER PUBLICATIONS

International Search Report dated May 17, 2017.

*Primary Examiner* — Mark A Laurenzi
*Assistant Examiner* — Deming Wan
(74) *Attorney, Agent, or Firm* — Ked & Associates LLP

(57) ABSTRACT

A compressor is provided in which an outer circumferential side cross-sectional area of a vane slot is formed smaller than an inner circumferential side cross-sectional area thereof to decrease an area receiving a force in a roller direction by a vane to reduce a contact force between the roller and the vane, and a gas accommodation portion selectively forming a suction pressure and an intermediate pressure is formed between the vane and the vane slot to control the contact force. A contact surface of the vane facing the roller is formed at a side of a compression chamber to reduce the contact force, and a space forming a discharge pressure is formed at at least either one side of a side surface of the vane and a cylinder to decrease a side directional reaction force applied to the vane, thereby reducing a friction between the vane and the cylinder.

17 Claims, 26 Drawing Sheets

(51) Int. Cl.
*F04C 27/00* (2006.01)
*F04C 29/00* (2006.01)
*F04C 23/00* (2006.01)

(52) U.S. Cl.
CPC ..... *F04C 27/005* (2013.01); *F04C 29/0085* (2013.01); *F01C 21/0827* (2013.01); *F04C 23/008* (2013.01); *F04C 2240/10* (2013.01); *F04C 2240/20* (2013.01); *F04C 2240/30* (2013.01); *F04C 2240/60* (2013.01)

(58) Field of Classification Search
USPC ..... 418/229
See application file for complete search history.

(56) References Cited

U.S. PATENT DOCUMENTS

| | | | | |
|---|---|---|---|---|
| 5,472,327 | A * | 12/1995 | Strikis | F04C 18/34 418/15 |
| 2011/0076169 | A1 | 3/2011 | Coffey et al. | |
| 2012/0260691 | A1 | 10/2012 | Hirayama | |
| 2014/0219845 | A1* | 8/2014 | Hugenroth | F01C 21/104 418/1 |

FOREIGN PATENT DOCUMENTS

| | | |
|---|---|---|
| JP | 06-264881 | 9/1994 |
| JP | 7-189924 | 7/1995 |

* cited by examiner

ROTARY COMPRESSOR HAVING FLUID PASSAGE BETWEEN SLIDING VANE AND VANE SLOT

CROSS-REFERENCE TO RELATED APPLICATIONS

The present disclosure relates to subject matter contained in priority Korean Application Nos. 10-2016-0013067 and 10-2016-0013071, filed on Feb. 2, 2016, which are herein expressly incorporated by reference in their entirety.

BACKGROUND OF THE INVENTION

1. Field of the Invention

The present disclosure relates to a compressor, and more particularly, to a rotary compressor divided into a suction chamber and a compression chamber by a vane being brought into contact with a rotating roller.

2. Description of the Related Art

In general, compressors may be divided into a rotating type and a reciprocating type according to a method of compressing refrigerant. The rotating type compressor varies a volume of a compression chamber while a piston performs a rotational or orbiting movement in a cylinder, and the reciprocating type compressor varies a volume of a compression space while a piston performs a reciprocal movement in a cylinder. A rotary compressor which compresses refrigerant while a piston rotates using a rotational force of a driving motor is well known as the rotary compressor.

The rotary compressor has continuously emphasized the development of technologies associated with high efficiency, miniaturization, and the like. Furthermore, the development of technologies for increasing a variation range of a compressor operating speed to satisfy more cooling capacity has been carried out.

The foregoing rotary compressors may be divided into a single rotary compressor and a dual rotary compressor. The dual rotary compressor may be also divided into a scheme in which a plurality of cylinders are stacked to form a plurality of compression spaces and a scheme in which a plurality of compression spaces are formed in one cylinder.

The former case is a scheme in which a plurality of rollers are provided on a rotational shaft with height differences, and the plurality of rollers alternately suck, compress and discharge refrigerant in each compression space while performing an eccentrically rotational movement in a compression space of each cylinder. Accordingly, the former case has a disadvantage in which a plurality of cylinders may be provided in an axial direction, thereby increasing a size of the compressor to that extent as well as increasing the material cost.

On the contrary, the latter case is a scheme in which one oval shaped roller 2 is provided on the rotating shaft 1, and the one roller 2 forms a plurality of compression spaces (V1)(V2) in one cylinder 4 along with two vanes (3A)(3B) to suck, compress and discharge refrigerant at the same time in both the compression spaces (V1)(V2) while performing an eccentrically rotational movement. Accordingly, the latter case has an advantage in which refrigerant is sucked, compressed and discharged at the same phase in the two compression spaces (V1)(V2) to decrease a mechanism sliding area, allow miniaturization and cancel a gas force toward an axial center, thereby allowing acceleration due to a decrease of journal portion reaction force.

However, the foregoing rotary compressor in the related art may have a problem of an overpressure loss due to a short compression period and a machine loss increase due to no roller rotation. In other words, as the vanes (3A)(3B) performing a linear movement is brought into contact with an outer circumferential surface of the roller 2 performing a rotational movement without rotation, a mechanical friction loss increases between the roller 2 and the vanes (3A)(3B). According to the mechanical friction loss generated between the roller 2 and the vanes (3A)(3B), a linear velocity proportionally may increase as increasing a number of vanes in the same inner diameter and height condition of the cylinder, thereby significantly reducing the compressor efficiency.

Furthermore, according to the rotary compressor in the related art, an front end of the vanes (3A)(3B) may be brought into contact with an outer circumferential surface of the roller 2 rotating without rotation to increase a mechanical friction loss between the roller 2 and the vanes (3A)(3B), but if a back pressure to each of the vanes (3A)(3B) is too reduced in consideration of this, it may cause a problem in which refrigerant is leaked into the suction chamber while decreasing a contact force between the vanes (3A)(3B) and the roller 2. Such a problem may increase refrigerant leakage since in case where the roller 2 is formed in an oval shape, a contact force between the vanes (3A)(3B) and the roller 2 decreases to the least value at a position where a rotating angle of the roller is 90° at a time point in which the vanes (3A)(3B) make contact with a minor axis of the roller 2.

Furthermore, the rotary compressor in the related art has a problem in which a release point at which the roller 2 is separated from the vanes (3A)(3B) may occur according to a rotation angle of the roller 2, and in particular, in case where the roller 2 is in an oval shape, a variation amount of a contact point between the vanes (3A)(3B) and the roller 2 increases, and due to this, an area of generating a release point between the vanes (3A)(3B) and the roller 2 also increases to limit the design freedom of the compressor.

Furthermore, according to the rotary compressor in the related art, as an end portion of the vanes (3A)(3B) facing the roller 2 is formed such that the center (O) of a curvature radius (R) is located at a length directional center line (CL) of the vanes (3A)(3B) as illustrated in FIG. 2A, an end area of the vane (3A) receiving a gas force (Fs) from a side of the suction chamber will be the same as that of the vane (3A) receiving a gas force (Fc) from the compression chamber, particularly on the basis of a contact point (P) at a rotation angle of 90°. It also has a problem in which a gas force that can be received by an end portion of the vane (3A) is limited to increase a mechanical friction loss generated between the vane and the roller.

Furthermore, according to the rotary compressor in the related art, the roller 2 is protruded from vane slots (4A)(4B) to partition between suction chambers (V11)(V21) and compression chambers (V12)(V22), and thus the vanes (3A)(3B) receives a side directional gas force (Fside) according to a pressure difference between the suction chamber and the compression chamber. As a result, the foregoing side directional gas force (Fside) is further applied to the second side surface (3*b*) protruded to the compression space (V1) while at the same time reaction forces (R1)(R2) in opposite directions to each other are generated on a first side surface (3*a*) facing an inner circumferential open end and a second side surface (3*b*) facing an outer circumferential open end of the vane slot (4A) on both side surfaces of the vane (3A) facing the vane slot (4A) as illustrated in FIG. 2B. Accordingly, the reaction forces (R1)(R2) applied to both side surfaces of the vane significantly may increase, thereby causing a problem of increasing a mechanical friction loss between the vane and the cylinder while the vane (3A) and the vane slot (4A) are excessively adhered to each other.

Furthermore, according to the rotary compressor in the related art, as the vanes (3A)(3B) receive a larger side directional gas force (Fside) in a suction chamber direction due to a pressure of the compression chamber in which the vanes (3A)(3B) have a relatively high pressure, a gap between the roller and the vane may be generated, thereby causing a problem in which refrigerant is leaked while a contact force between the roller and the vane excessively decreases. It may increase an area of the vane exposed to the compression chamber while increasing a maximum protrusion amount of the vanes (3A)(3B) in case of an oval shaped roller 2, and due to this, a side directional gas force (Fside) receiving at the compression chamber by the vane may further increase, thereby causing a problem of increasing refrigerant leakage.

SUMMARY OF THE INVENTION

An aspect of the present disclosure is to provide a compressor capable of reducing a force received by the vane in the roller direction to lower a contact force between the roller and the vane, thereby reducing a mechanical friction loss between the roller and the vane.

Another aspect of the present disclosure is to provide a compressor capable of allowing a contact force between the vane and the roller to differ according to a protrusion amount of the vane, thereby appropriately controlling a mechanical friction loss to enhance the compressor efficiency.

Still another aspect of the present disclosure is to provide a compressor capable of supplying a back pressure to the vane during a section in which a release point between the vane and the roller is generated, thereby preventing the vane from being released.

Yet still another aspect of the present disclosure to provide a compressor capable of increasing a drag force to the vane acting in an opposite direction of the roller, thereby decreasing a contact force between the roller and the vane.

Still yet another aspect of the present disclosure is to provide a compressor capable of integrally forming the roller into the rotating shaft to decrease a contact force between the roller and the vane while reducing a friction loss due to the rotation of the roller, thereby reducing a total mechanical friction loss.

Yet still another aspect of the present disclosure is to provide a compressor capable of reducing a reaction force applied in a side direction of the vane, thereby reducing a mechanical friction loss between the vane and the cylinder.

Still yet another aspect of the present disclosure is to provide a compressor capable of preventing a contact force between the roller and the vane from being excessively decreased, thereby suppressing refrigerant from being leaked between the roller and the vane.

In order to accomplish the objective of the present disclosure, a compressor may be provided in which a rear end cross-sectional area of the vane is formed to be smaller than a front end cross-sectional area thereof to decrease an area receiving a force in a roller direction, thereby reducing a contact force between the roller and the vane.

Furthermore, in order to accomplish the objective of the present disclosure, a compressor may be provided in which a gas accommodation portion capable of selectively forming a suction pressure and an intermediate pressure is formed between the vane and the vane slot, thereby appropriately controlling a contact force between the vane and the roller.

Furthermore, in order to accomplish the objective of the present disclosure, a compressor may be provided in which a contact surface of the vane facing the roller may be broadly formed at a side of a compression chamber, thereby appropriately increasing a force received in an opposite direction of the roller.

Furthermore, in order to accomplish the objective of the present disclosure, there is provided a compressor, including a drive motor; a rotating shaft configured to transfer a rotational force of the drive motor; a cylinder provided at one side of the drive motor; a roller provided on the rotating shaft to rotate, and allow at least two or more portions on an outer circumferential surface thereof to face an inner circumferential surface of the cylinder to form at least two compression spaces in the cylinder; and at least two or more vanes configured to face an outer circumferential surface of the roller to partition the two or more compression spaces into a suction chamber and a compression chamber, respectively, wherein at least two or more vane slots having an inner surface are formed in the cylinder to face both side surfaces of the vane, and an outer circumferential cross-sectional area of the vane slot is formed to be smaller than an inner circumferential cross-sectional area thereof.

Here, a slot side step portion stepped by a predetermined length in an outer circumferential direction from an inner circumferential end portion of the vane slot may be formed on a side surface of the vane slot, and a vane side step portion stepped in an opposite direction to the slot side step portion may be formed on a side surface of the vane corresponding to the slot side step portion.

Furthermore, a space in which a volume thereof varies according to the movement of the vane may be formed between the slot side step portion and the vane side step portion.

Furthermore, a communication passage for communicating the space with a suction chamber may be formed in the cylinder.

Furthermore, a communication passage for communicating the space with a suction chamber may be formed in the cylinder and the vane, respectively.

Furthermore, the communication passage may be formed to block between the suction chamber and the space on a portion having a lowest linear velocity, but communicate between the suction chamber and the space on a portion having a highest linear velocity between the roller and the vane.

Furthermore, the communication passage may include a vane side communication groove formed on a side surface of the vane; and a slot side communication groove formed in the cylinder to selectively communicate between the vane side communication groove and the space according to the movement of the vane.

Furthermore, a vane side sealing portion facing the vane slot to secure a sealing area may be formed at a front side of the vane side step portion, and the vane side communication groove may be formed on the vane side sealing portion, and the slot side communication groove may be formed within the slot side step portion.

Furthermore, the vane side communication groove may be formed at least either one edge of both a top and a bottom edge of the vane side sealing portion, and the slot side communication groove may be formed at least either one edge of both a top and a bottom edge of the slot side step portion.

Here, the vane may include a vane body; and a vane protrusion convexly formed at a front end of the vane body, wherein the center of a curvature radius of the vane protrusion is eccentrically formed with respect to a length directional center line of the vane body.

Furthermore, in order to accomplish the objective of the present disclosure, there is a compressor, including a casing: a drive motor provided in an inner space of the casing; a rotating shaft configured to transfer a rotational force of the drive motor; a roller provided on the rotating shaft to rotate, and allow at least two or more portions of an outer circumferential surface thereof to face an inner circumferential surface of the cylinder to form at least two compression spaces in the cylinder; and at least two or more vanes configured to face an outer circumferential surface of the roller to partition the two or more compression spaces into a suction chamber and a compression chamber, respectively, wherein at least two or more vane slots having an inner surface are formed in the cylinder to face both side surfaces of the vane, and a back pressure space forming an intermediate pressure which is an intermediate value of a suction pressure and a discharge pressure is formed between the vane slot and a side surface of a vane corresponding thereto.

Here, the back pressure space may be blocked from the suction chamber at a time point in which a protrusion amount of the vane is the highest to form an intermediate pressure chamber.

Furthermore, a volume of the back pressure space varies according to the movement of the vane.

Here, the vane may include a vane body; and a vane protrusion convexly formed at a front end of the vane body, wherein the center of a curvature radius of the vane protrusion is eccentrically formed with respect to a length directional center line of the vane body.

Furthermore, in order to accomplish the objective of the present disclosure, there is provided a compressor, including a casing; a cylinder provided in an inner space of the casing; a roller configured to concentrically rotate with the cylinder within the cylinder to form at least two or more compression spaces in the cylinder; and two or more vanes configured to face an outer circumferential surface of the roller to be slidably coupled to the cylinder to partition the two or more compression spaces into a suction chamber and a compression chamber, respectively, wherein a space in which a volume thereof varies according to the movement of the vane is formed between on side surface of the vane and a cylinder corresponding thereto, and the space is communicated with the suction chamber through a communication passage provided in the cylinder or the vane.

Here, the communication passage may be open at a time point in which a protrusion amount of the vane is the lowest.

Furthermore, the communication passage may be open at a time point in which a protrusion amount of the vane is the highest.

Here, the vane may include a vane body; and a vane protrusion convexly formed at a front end of the vane body, wherein the center of a curvature radius of the vane protrusion is eccentrically formed with respect to a length directional center line of the vane body.

Furthermore, in order to accomplish the objective of the present disclosure, there is provided a compressor, including a drive motor; a rotating shaft configured to transfer a rotational force of the drive motor; a cylinder provided at one side of the drive motor; a roller provided on the rotating shaft to rotate, and allow at least two or more portions on an outer circumferential surface thereof to face an inner circumferential surface of the cylinder to form at least two compression spaces in the cylinder; and at least two or more vanes configured to face an outer circumferential surface of the roller to partition the two or more compression spaces into a suction chamber and a compression chamber, respectively, wherein the vane includes a vane body; and a vane protrusion convexly formed at a front end of the vane body, and the center of a curvature radius of the vane protrusion is eccentrically formed with respect to a length directional center line of the vane body.

Here, a curvature radius of the vane protrusion is greater than or equal to a half of the width of the vane protrusion, and less than or equal to the width of the vane protrusion.

Furthermore, in order to accomplish the objective of the present disclosure, there is provided a compressor, including a drive motor, a rotating shaft configured to transfer a rotational force of the drive motor; a cylinder provided at one side of the drive motor, and provided with a vane slot an inner circumferential side of which is open; a roller provided on the rotating shaft to rotate; and a vane movably provided on a vane slot of the cylinder to face an outer circumferential surface of the roller, and partition a compression space formed by the cylinder and the roller into a suction chamber and a compression chamber, wherein an outer circumferential cross-sectional area of the vane slot is formed to be smaller than an inner circumferential cross-sectional area thereof.

Here, the vane includes a vane body; and a vane protrusion convexly formed at a front end of the vane body, and the center of a curvature radius of the vane protrusion is eccentrically formed with respect to a length directional center line of the vane body.

Furthermore, in order to accomplish the objective of the present disclosure, there is provided a compressor, including a drive motor, a rotating shaft configured to transfer a rotational force of the drive motor; a cylinder provided at one side of the drive motor; a roller integrally provided in the rotating shaft to rotate; and a vane movably provided on the cylinder to face an outer circumferential surface of the roller, and partition a compression space formed by the cylinder and the roller into a suction chamber and a compression chamber, wherein an outer circumferential cross-sectional area of the vane slot is formed to be smaller than an inner circumferential cross-sectional area thereof.

Here, a back pressure chamber may be formed between the vane slot and the vehicle.

Furthermore, the vane includes a vane body; and a vane protrusion convexly formed at a front end of the vane body, and the center of a curvature radius of the vane protrusion is eccentrically formed with respect to a length directional center line of the vane body.

Furthermore, in order to accomplish the objective of the present disclosure, there is provided a compressor, including a drive motor, a rotating shaft configured to transfer a rotational force of the drive motor; a cylinder provided at one side of the drive motor; a roller integrally provided in the rotating shaft to rotate; and a vane movably provided on the cylinder to face an outer circumferential surface of the roller, and partition a compression space formed by the cylinder and the roller into a suction chamber and a compression chamber, wherein the vane includes a vane body; and a vane protrusion convexly formed at a front end of the vane body, and the center of a curvature radius of the vane protrusion is eccentrically formed with respect to a length directional center line of the vane body.

Furthermore, in order to accomplish the objective of the present disclosure, there is provided a compressor in which a space filled with a discharge pressure is formed between the cylinder and vane, thereby cancelling a gas force received from the compression chamber by the vane.

Furthermore, in order to accomplish the objective of the present disclosure, there is provided a compressor in which a contact surface of the vane facing the roller is broadly formed at a side of a compression chamber to increase a force received in an opposite direction of the roller by the vane so as to reduce a contact force between the vane and the roller, thereby reducing a contact loss between the cylinder and the vane.

Furthermore, in order to accomplish the objective of the present disclosure, there is provided a compressor, including a casing; a drive motor provided in an inner space of the casing; a rotating shaft configured to transfer a rotational force of the drive motor; a roller provided on the rotating shaft to rotate, and allow at least two or more portions of an outer circumferential surface thereof to face an inner circumferential surface of the cylinder to form at least two compression spaces in the cylinder; and at least two or more vanes configured to face an outer circumferential surface of the roller to partition the two or more compression spaces into a suction chamber and a compression chamber, respectively, wherein a space portion having a predetermined volume to form a discharge pressure is formed on a side surface of the vane or a cylinder corresponding thereto.

Here, the space portion may be formed on a surface corresponding to the suction chamber based on the vane.

Furthermore, the space portion may be communicated with an inner space of the casing.

Furthermore, an outer circumferential end portion of the space portion may be communicated with an inner space of the casing in a state that the vane is protruded to the maximum in a compression space.

Furthermore, the space portion may be formed on a side surface of the vane.

Furthermore, the space portion may be formed at a middle of the side surface of the vane.

Furthermore, the space portion may be formed to be stepped by a predetermined length from an opposite end portion of the roller to a side of the roller.

Furthermore, the space portion may be formed at a middle of a height direction of the vane, and a bearing surface facing the cylinder may be formed at either one side of both a top and a bottom side of the space portion.

Furthermore, a vane slot may be formed to insert the vane, and at least part of the space portion is formed to overlap with the vane slot, and a length of a portion overlapping with the vane slot in the space portion may increase or decrease in proportion to a length protruded to the compression space from the vane.

Furthermore, a length of a portion overlapping with the vane slot in the space portion may be formed to be the same as that of the vane protruded to the compression space.

Furthermore, the space portion may be formed in a cylinder corresponding to a side surface of the vane.

Furthermore, a vane slot into which the vane is inserted may be formed on the cylinder, and the vane slot may be formed with an inner circumferential open surface and an outer circumferential open surface, and the space portion may be formed on an inner wall surface of the vane slot in an inner circumferential open surface direction from an outer circumferential open surface.

Furthermore, in order to accomplish the objective of the present disclosure, there is provided a compressor, including a casing; a drive motor provided in an inner space of the casing; a rotating shaft configured to transfer a rotational force of the drive motor; a roller provided on the rotating shaft to rotate; and a vane movably provided on the cylinder to face an outer circumferential surface of the roller, and partition a compression space formed by the cylinder and the roller into a suction chamber and a compression chamber, wherein a space portion having a predetermined volume to form a discharge pressure is formed on a side surface of the vane or a cylinder corresponding thereto.

Here, the space portion may be formed on a surface corresponding to the suction chamber based on the vane.

Furthermore, in order to accomplish the objective of the present disclosure, there is provided a compressor, including a drive motor, a rotating shaft configured to transfer a rotational force of the drive motor; a cylinder provided at one side of the drive motor; a roller integrally provided in the rotating shaft to rotate; and a vane movably provided on the cylinder to face an outer circumferential surface of the roller, and partition a compression space formed by the cylinder and the roller into a suction chamber and a compression chamber, wherein a space portion having a predetermined volume to form a discharge pressure is formed on a side surface of the vane or a cylinder corresponding thereto.

Here, the space portion may be formed on a surface corresponding to the suction chamber based on the vane.

The rotary compressor according to the present disclosure may form an outer circumferential side cross-sectional area of a vane slot to be smaller than an inner circumferential side cross-sectional area thereof to form a rear end cross-sectional area of the vane to be smaller than a front end cross-sectional area thereof, and through this, it may be possible to decrease an area receiving a force in the roller direction by the vane so as to reduce a contact force between the roller and the vane, thereby reducing a mechanical friction loss between the roller and the vane to enhance the compressor efficiency.

Furthermore, a gas accommodation portion capable of selectively forming a suction pressure and an intermediate pressure may be formed between the vane and the vane slot to appropriately control a contact force between the vane and the roller, thereby further increasing the compressor efficiency.

Furthermore, a contact surface of the vane facing the roller may be broadly formed at a side of a compression chamber to increase a force received in an opposite direction of the roller by the vane so as to reduce a contact force between the roller and the vane, thereby further increasing the compressor efficiency.

The rotary compressor according to the present disclosure may form a space portion having a discharge pressure between the vane and the vane slot corresponding thereto to decrease a side directional reaction force applied to the vane, thereby reducing a mechanical friction loss between the vane and the cylinder.

Furthermore, through this, a back pressure applied to the vane may be prevented from being excessively decreased to suppress refrigerant leakage that can be generated while separating between the vane and the roller, thereby enhancing the compressor efficiency.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, a compressor according to present disclosure will be described in detail based on an embodiment illustrated in the accompanying drawings.

Figure 1:
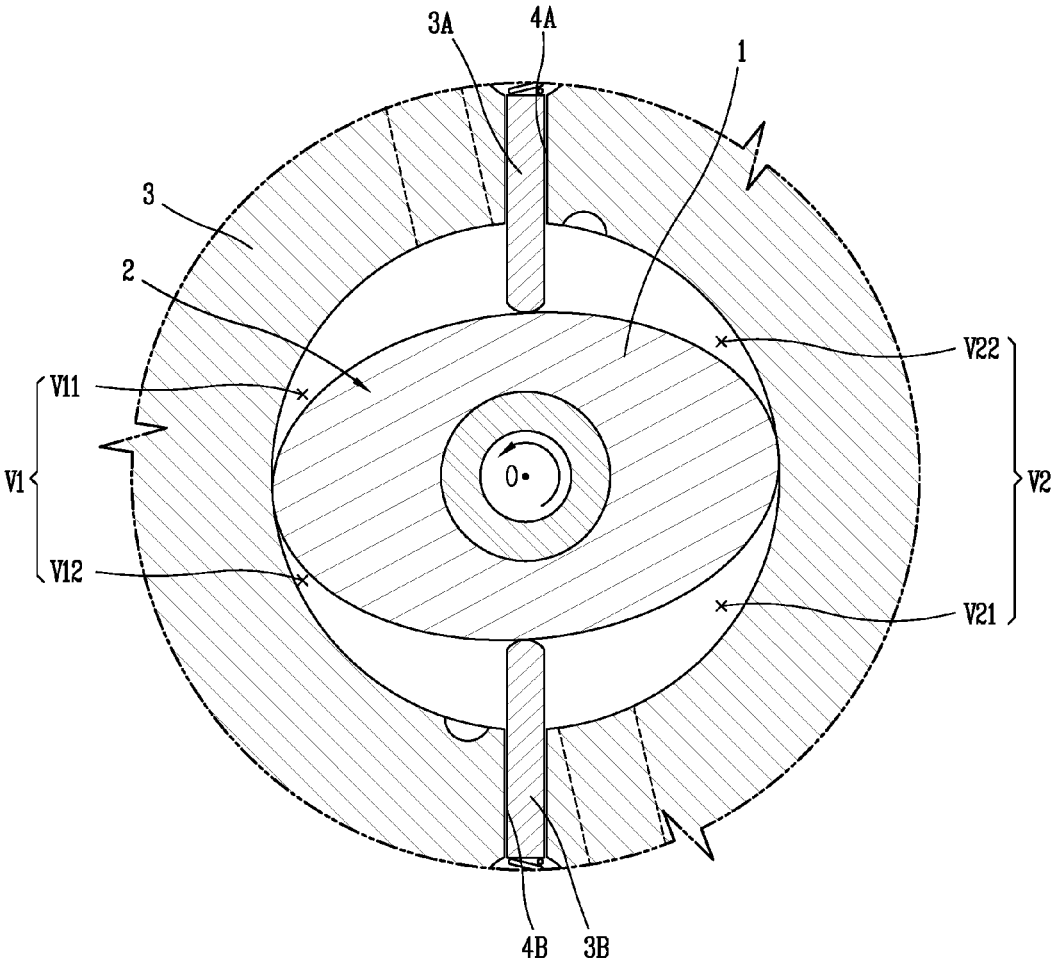
FIG. 1 RELATED ART
FIG. 1 is a transverse cross-sectional view illustrating an example of an oval shaped rotary compressor in the related art.
Figure 2A:
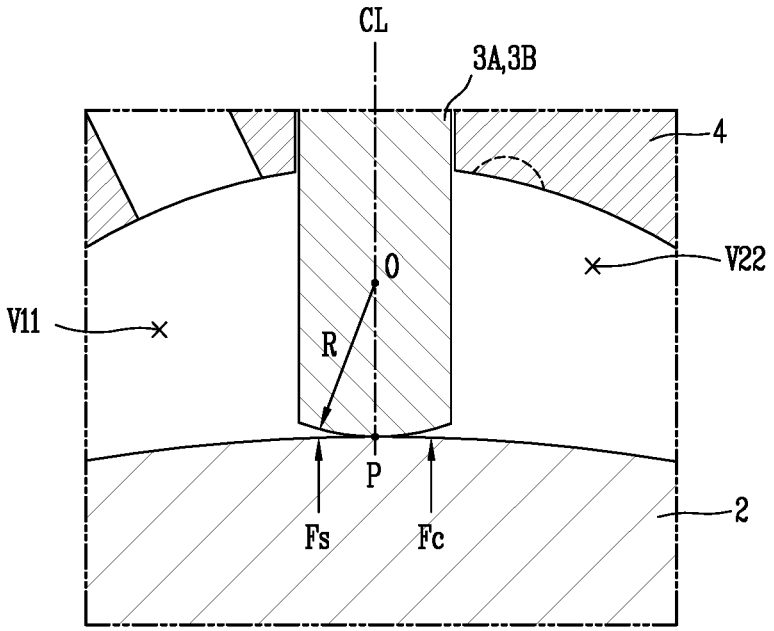
FIG. 2A RELATED ART
FIG. 2A is a transverse cross-sectional view illustrating a contact state between a vane and a roller in the rotary compressor according to FIG. 1.
Figure 2B:
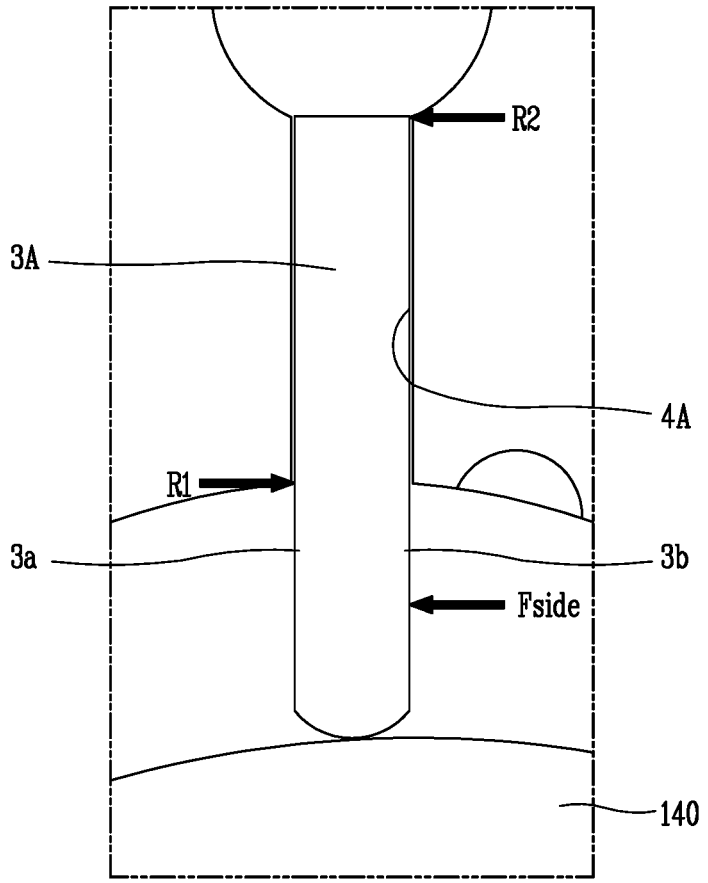
FIG. 2B RELATED ART
FIG. 2B is a transverse cross-sectional view illustrating the relationship of forces applied to the vane in the rotary compressor according to FIG. 1.
Figure 3:
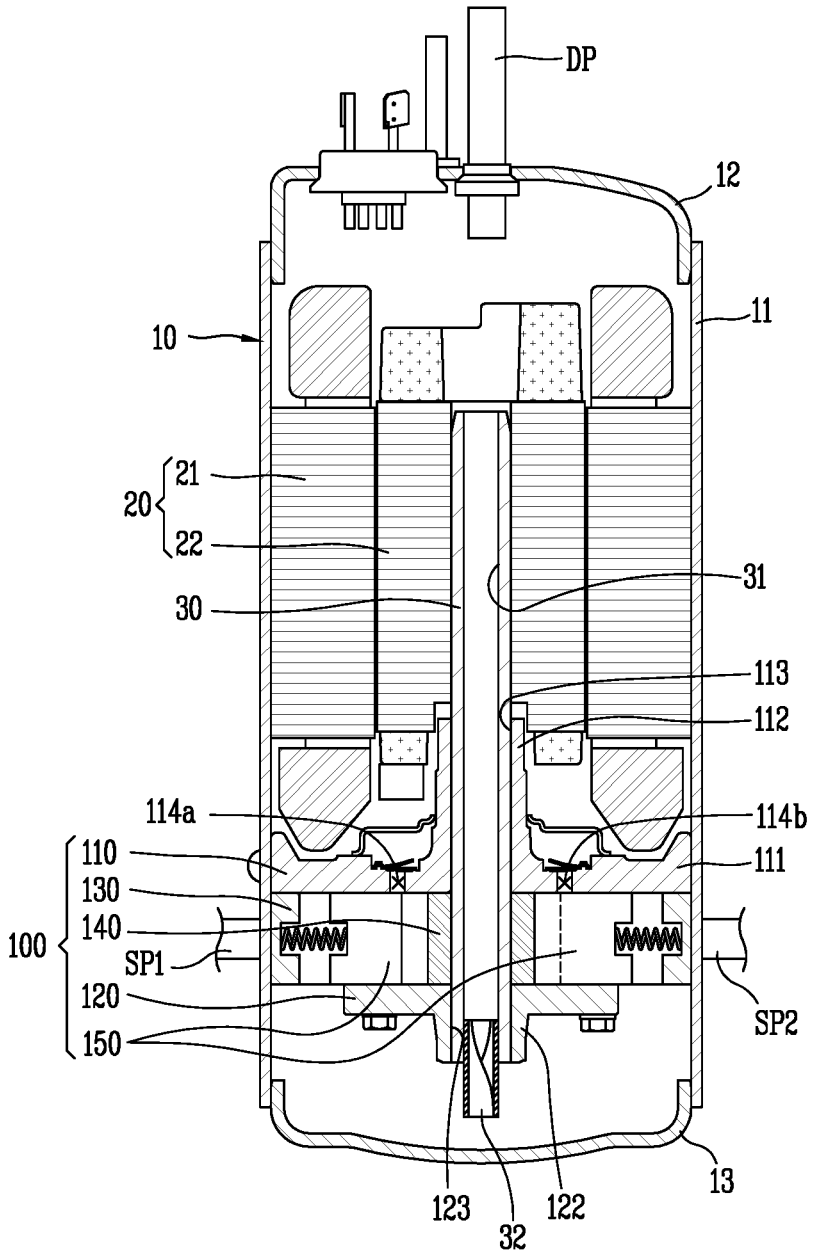
FIG. 3 is a longitudinal cross-sectional view illustrating an oval shaped rotary compressor according to the present disclosure.
Figure 4:
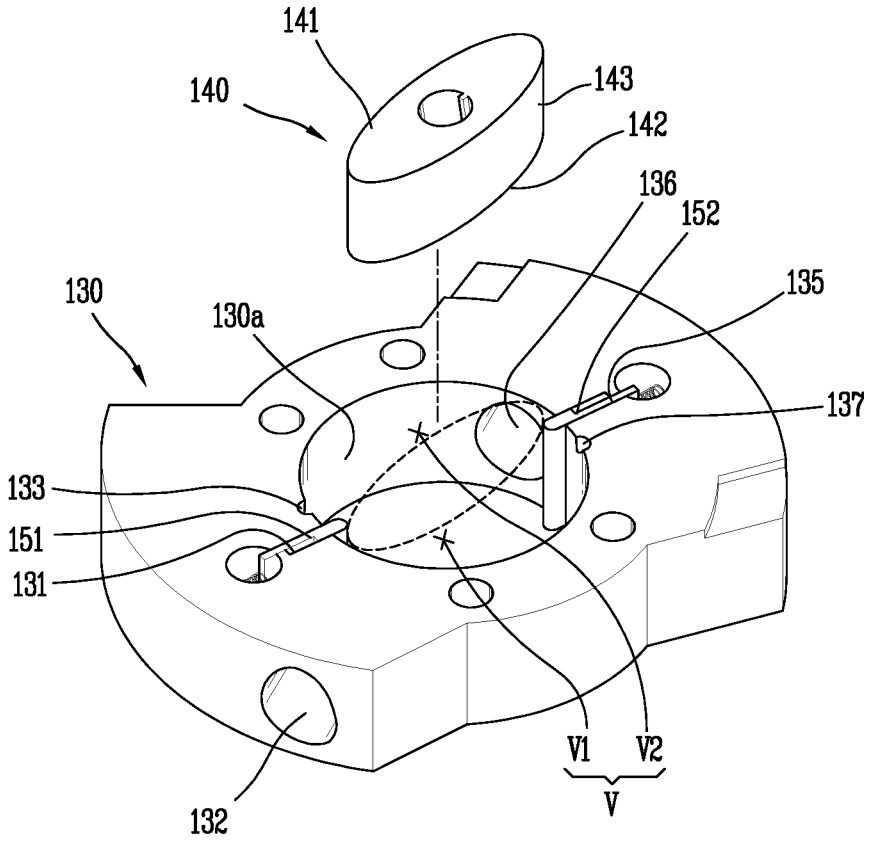
FIG. 4 is an exploded perspective view illustrating a compression section in the compressor according to FIG. 3.
Figure 5:
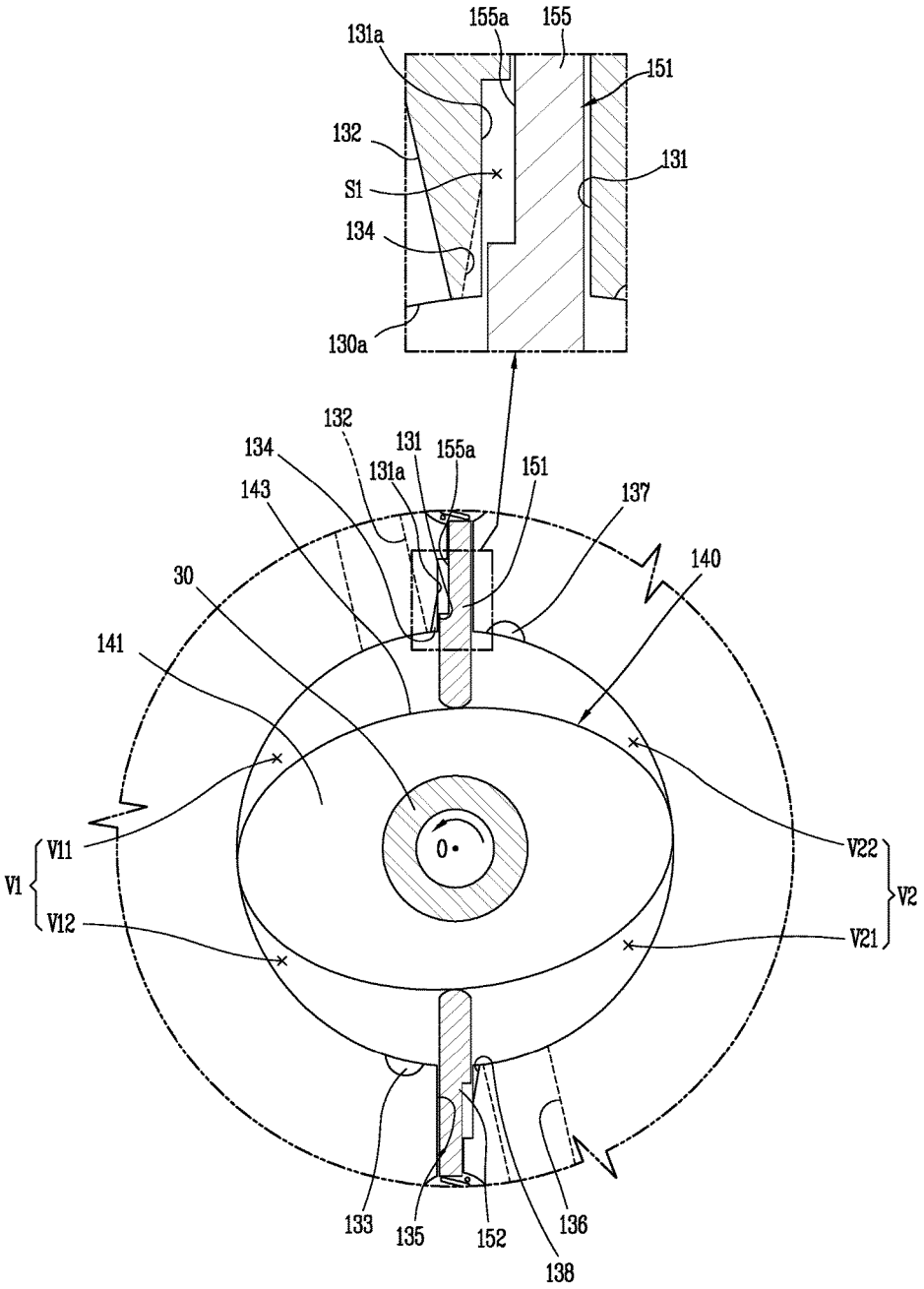
FIG. 5 is a transverse directional view illustrating a compression section in the compressor according to FIG. 3.

FIG. 3 is a longitudinal cross-sectional view illustrating an oval shaped rotary compressor according to the present disclosure, and FIG. 4 is an exploded perspective view illustrating a compression section in the compressor according to FIG. 3, and FIG. 5 is a transverse directional view illustrating a compression section in the compressor according to FIG. 3.

As illustrated in the drawings, in a rotary compressor according to the present embodiment, a motor drive 20 is provided within a casing 10, and a compression section 100 mechanically connected by a rotating shaft 30 may be provided at a lower side of the motor drive 20.

The casing 10 may include a cylindrical shell 11, an upper shell 12 configured to cover an upper portion of the cylindrical shell 11, and a lower shell 13 configured to cover a lower portion of the cylindrical shell 11.

A first refrigerant suction pipe (SP1) communicating with a first compression space (V11) which will be described later of the compression section 100 and a second refrigerant suction pipe (SP2) communicating with a second compression space (V12) may be coupled in a penetrating manner to a side surface of the cylindrical shell 11. The first refrigerant suction pipe (SP1) and second refrigerant suction pipe (SP2) may be coupled to both sides thereof at an interval of 180° in a circumferential direction.

A refrigerant discharge pipe (DP) communicating with an inside of the casing 10 may be coupled in a penetrating manner to an upper portion of the upper shell 12. The refrigerant discharge pipe (DP) corresponds to a path through which compressed refrigerant discharged from a compression section 4 to an inner space of the casing 10 is exhausted to an outside of the casing 10, and an oil separator (not shown) for separating an oil mixed into the discharged refrigerant may be connected to an inside of the casing 10 or the refrigerant discharge pipe (DP) and installed at an outside of the casing 10.

The motor drive 20 may include a stator 21 pressed and fixed to an inner circumferential surface of the casing 10, and a rotor 22 rotatably inserted and installed at an inside of the stator 21.

An end of the rotating shaft 30 may be pressed and coupled to the rotor 22, and the other end of the rotating shaft 30 may be supported by a main bearing 110 and a sub-bearing 120 which will be described later.

The rotating shaft 30 may be formed with an oil passage 31 for guiding oil to a sliding portion in an axial direction, and coupled to an oil feeder 32 for absorbing oil stored in the lower shell 13 may be coupled to an end portion at a side of the lower shell 13 of the rotating shaft 30.

The compression section 100 may include the main bearing 110 and sub-bearing 120 configured to support the rotating shaft 30, a cylinder 130 installed between the main bearing 110 and the sub-bearing 120 to form a compression space, a roller 140 formed on the rotating shaft 30 to perform a rotational movement in a compression space (V) of the cylinder 130, and a vane 150 brought into contact with an outer circumferential surface of the roller 140 and movably coupled to the cylinder 130. The roller 140 may face an inner circumferential surface 130*a* of the cylinder 130 at at least two or more positions to partition the compression space (V) of the cylinder 130 into at least two more sections, and at least two or more the vanes 150 may be provided to partition two or more compression spaces into a suction chamber and a compression chamber, respectively. Hereinafter, a compression section having two compression spaces will be described as a representative example.

The main bearing 110 may be formed in a disk shape, and a side wall portion 111 may be formed at an edge thereof to be shrink-fitted or welded to an inner circumferential surface of the casing 10. A main shaft receiving portion 112 may be protruded in an upward direction at the center of the main bearing 110, and a shaft receiving hole 113 may be formed in a penetrating manner on the main shaft receiving portion 112 to insert and support the rotating shaft 30.

A first discharge port 114*a* and a second discharge port 114*b* communicating with the first compression space (V1) and second compression space (V2) to discharge refrigerant compressed in the respective compression spaces (V1)(V2) which will be described later may be formed at one side of the main shaft receiving portion 112.

The first discharge port 114*a* and second discharge port 114*b* may be formed at an interval of 180° in an inner circumferential direction. However, the first discharge port and second discharge port may be formed on the sub-bearing 120 according to circumstances.

The sub-bearing 120 may be formed in a disk shape and fastened to the main bearing 110 with the cylinder 130 through a bolt. Of course, when the cylinder 130 is fixed to the casing 10, the sub-bearing 120 may be fastened to the cylinder 130 with the main bearing 110 through a bolt, and when the sub-bearing 120 is fixed to the casing 10, the cylinder 130 and main bearing 110 may be fastened to the sub-bearing 120 through a bolt.

Furthermore, a sub-shaft receiving portion 122 may be formed downward in a penetrating manner at the center of the sub-bearing 120, and a shaft receiving hole 123 penetrated on the same axial line with a shaft receiving hole 113 of the main bearing 110 to support a lower end of the rotating shaft 30 may be formed on the sub-shaft receiving portion 122.

The cylinder 130 may be formed in an annular shape in which an inner circumferential surface 130*a* thereof is in a perfect circular shape. Furthermore, a first vane slot 131 and a second vane slot 135 for allowing a first vane 151 and a second vane 152 which will be described later to be movably inserted thereinto in a radial direction may be formed at both sides of an inner circumferential surface of the cylinder 130.

The first vane slot 131 and second vane slot 135 may be formed in a radial direction, but according to circumstances, an inner circumferential open surface may be formed in an inclined manner to be located at a discharge side with respect to a virtual line passing through the rotation center of the roller 140. Furthermore, the first vane slot 131 and second vane slot 135 may be formed at an interval of 180° in a circumferential direction.

A first suction port 132 and a second suction port 136 may be formed at one side in a circumferential direction of the first vane slot 131 and second vane slot 135.

The first suction port 132 and second suction port 136 may be formed at an interval of 180° in a circumferential direction. The first suction port 132 and second suction port 136 may be formed on the cylinder 130, but according to circumstances, may be formed on the sub-bearing or main bearing.

A first discharge guide groove 133 and a second discharge guide groove 137 may be formed at the other side in a circumferential direction of the first vane slot 131 and second vane slot 135 to correspond to the first discharge port 114*a* and second discharge port 114*b* of the main bearing, respectively.

The first discharge guide groove 133 and second discharge guide groove 137 may be formed at an interval of 180° in a circumferential direction. Here, the first discharge guide groove 133 and second discharge guide groove 137 may not be formed according to circumstances.

The roller 140 may be integrally formed into the rotating shaft 30 or post-assembled and coupled to the rotating shaft 30. The roller 140 may be formed in an oval shape in which an outer circumferential surface of the roller faces an inner circumferential surface 130*a* forming the compression space (V) of the cylinder 130 at two positions.

The roller 140 may be formed in a three-dimensional shape in which an oval shaped plane is projected in a direction perpendicular to the plane. In this case, a major axis length of the roller 140 may be formed to have substantially the same length as an inner diameter of the cylinder 130, and a minor axis length of the roller 140 may be formed to be smaller than an inner diameter of the cylinder 130. As a result, the roller 140 may rotate while being concentric with the compression space (V) and rotating shaft 30 of the cylinder in a state that a top surface 141 thereof faces a bottom surface of the main bearing 110, and a bottom surface 142 of the roller faces a top surface of the sub-bearing 120, and oval major axis directional both vertices on an outer circumferential surface 143 of the roller 140 faces the inner circumferential surface 130*a* of the cylinder 130, respectively. Here, a portion excluding oval major axis directional both vertices on the outer circumferential surface 143 of the roller 140 may be separated from the inner circumferential surface 130*a* of the cylinder 130.

On the other hand, the vane 150 may include a first vane 151 and a second vane 152. The first vane 151 and second vane 152 are formed with the same shape and disposed at an interval of 180° along a circumferential direction, and thus, hereinafter, the present disclosure will be described around the first vane.

The first vane 151 may include a first vane body 155 slidably inserted into the first vane slot 131, and a first vane protrusion 156 convexly protruded and formed at a front end (an end portion in a roller direction) of the first vane body 155.

The first vane body 155 may be formed in a substantially rectangular shape having a predetermined length, width and height.

A length of the first vane 151 may be formed in a length in which the first vane body can be sufficiently supported by the first vane slot 131 when protruded to the maximum from the first vane slot 131 while the first vane body is released from the first vane slot 131 when the first vane 151 moves in a state of facing an outer circumferential surface of the roller 140. In addition, the length of the first vane may be preferably formed in a length in which the first vane body can maintain a friction loss generated between the first vane slot 131 to the minimum. Here, the length of the first vane is a sum of the first vane body 155 and the first vane protrusion 156 as a distance extended in a moving direction of the first vane 151.

A width of the first vane 151 may be appropriately adjusted in consideration of a strength of the vane, a volume of the compression space, and the like. In other words, when the width of the first vane 151 is too large, a dead volume generated at both sides of a contact point between the vane and the roller may increase, and when the width of the vane is too small, a pressure of the compression chamber may not be sufficiently supported to reduce reliability. Here, the width of the first vane 151 is a distance in a direction perpendicular to a length direction of the first vane on a plane perpendicular to an axial direction of the rotating shaft 30 on the first vane body.

A height of the first vane 151 may be formed at a height for preventing both compression spaces (V1)(V2) partitioned by the first vane 151 from being communicated with each other. In other words, the height of the first vane 151 may be formed at a height capable of facing the main bearing 110 and sub-bearing 120. Here, the height of the first vane 151 is a distance in a direction perpendicular to both the length and width of the vane body or vane protrusion.

The first vane protrusion 156 may be formed in various ways. For example, a curvature radius of the first vane protrusion 156 may be formed to be the same as a half of a thickness between both side portions of the first vane body 155. Accordingly, the first vane protrusion 156 may be formed in a semi-circular shape on a cross section perpendicular to the rotating shaft 30. As a result, the first vane protrusion 156 may be connected to both side portions of the first vane 151 in a non-angled shape, respectively, and the first vane protrusion 156 may be formed to have a common tangent line to both side portions of the first vane 151, respectively, and face them.

Furthermore, the first vane protrusion 156 may be formed such that a curvature radius of thereof is larger than a half of a thickness between both side portions of the first vane 151. In this case, a contact portion to the first vane protrusion 156 may increase to suppress an abrasion of the first vane protrusion 156.

Furthermore, the center point (the center of a curvature radius) (P) of the first vane protrusion 156 may be formed on a length directional center line (CL) of the first vane body 155. Accordingly, when the roller 140 is located at a rotation angle of 90°, it may be in a configuration that the center point (P) of the first vane protrusion is brought into contact with an outer circumferential surface of the roller 140.

On the other hand, the second vane 152 is formed to be the same as the first vane 151, and thus the detailed description thereof will be omitted.

On the drawing, reference numeral 130*b* is a through hole of a cylinder in which an inner space of the casing is communicated with the vane slot, and V11 and V12 are a first suction chamber and a first compression chamber forming a first compression space, and V21 and V22 are a second suction chamber and a second compression chamber forming a second compression space.

In the foregoing rotary compressor according to the present embodiment, when power is applied to the motor drive 20 to rotate the rotor 22 of the motor drive 20 and the rotating shaft 30 coupled to the rotor 22, the roller 140 sucks refrigerant into the first suction chamber (V11) of the first compression space (V1) and the second suction chamber (V21) of the second compression space (V2) at the same time while rotating along with the rotating shaft 30.

A series of processes of compressing the refrigerant in the first compression chamber (V12) of the first compression space (V1) and the second compression chamber (V22) of the second compression space (V2) at the same time by the roller 140, the first vane 151 and the second vane 152, and discharging the compressed refrigerant to an inner space of the casing 10 through the first discharge port 114*a* and second discharge port 114*b* provided in the main bearing 110 at the same time will be repeated.

As refrigerant is sucked into the first compression space (V1) and second compression space (V2) at the same time and compressed in both the compression space (V1)(V2) as described above, gas forces transferred in a central direction of the rotating shaft 30 may be cancelled by each other, and thus a reaction force in a radial direction may become substantially zero to significantly reduce the compressor vibration.

However, when a roller has an oval shape and two vanes are brought into contact with an outer circumferential surface of the roller, respectively, as illustrated in the present embodiment, the roller faces the vanes at two contact points. Accordingly, a mechanical friction loss between the roller and the vane may increase compared to a circular shaped roller in the related art as well as the roller may be unable to perform rotation to increase a linear velocity between the vane and the roller, thereby further increasing a mechanical friction loss.

Accordingly, reducing a contact force between the vane and the roller and decreasing a linear velocity may reduce a mechanical friction loss to enhance the compressor efficiency. However, there is a limit in reducing the linear velocity since the linear velocity between the vane and the roller relates to an eccentricity of an oval shaped roller dependent on the diameter and height of the cylinder subsequent to determining a stroke volume of the compressor, and there exists a resultant high efficiency region. Accordingly, a scheme of reducing a contact force between the vane and the roller will be preferentially taken into consideration.

In order to reduce a contact force between the vane and the roller as described above, it may be possible to decrease a force applied to a rear end of the vane in a roller direction or increase a force pushing the vane in an opposite direction of the roller. The first vane and the second vane may be formed in the same shape, and thus, hereinafter, the first vane will be described as a representative example. Accordingly, a vane may refer to a first vane but may actually include both a first vane and a second vane.

Figure 6:
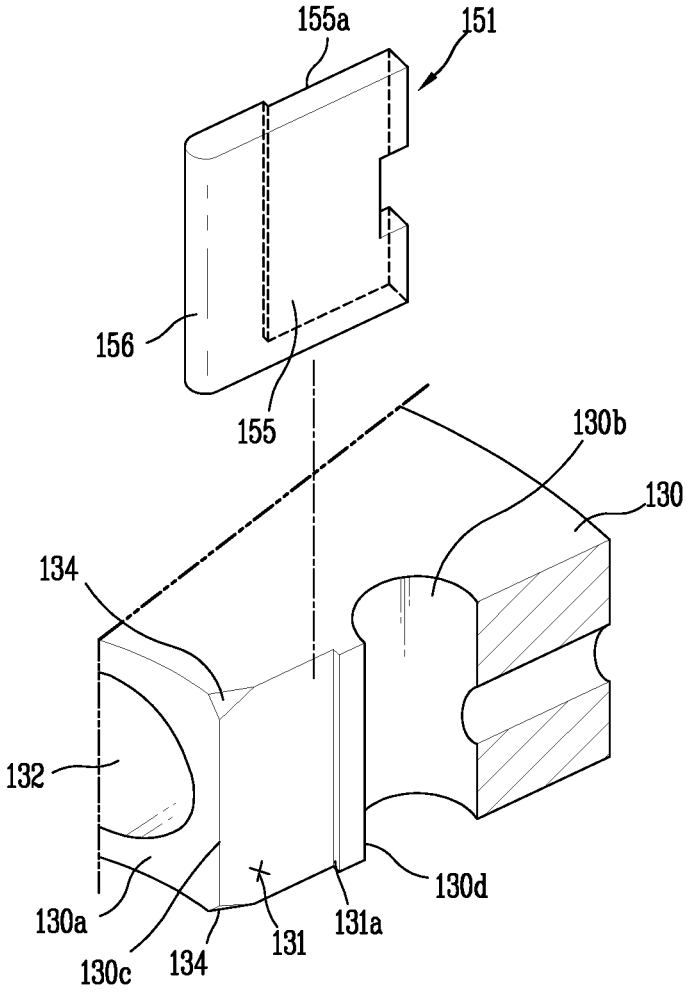
FIGS. 6 and 7 are an exploded perspective view and a coupled transverse cross-sectional view illustrating an embodiment of a vane and a vane slot in the compression section according to FIG. 5.
Figure 7:
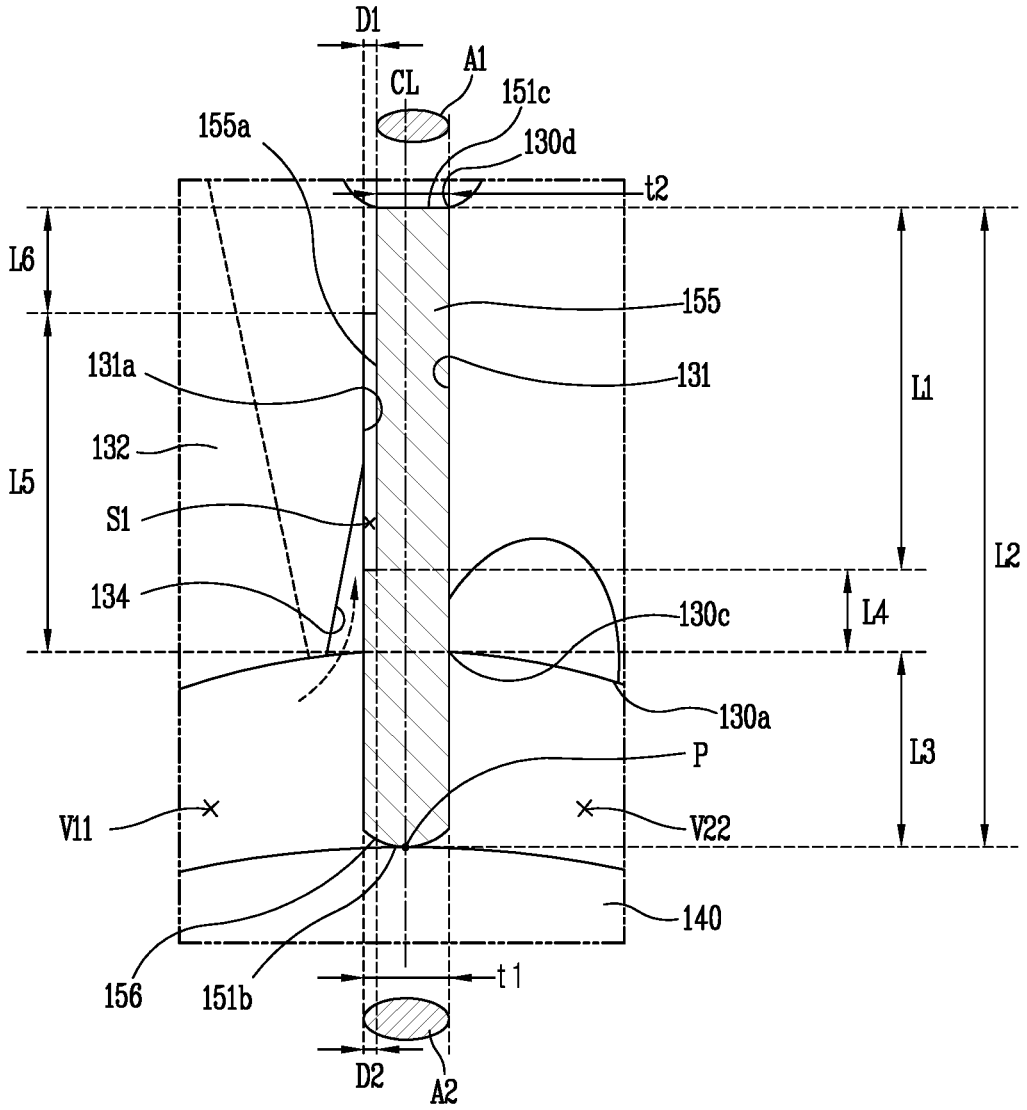
Figure 8:
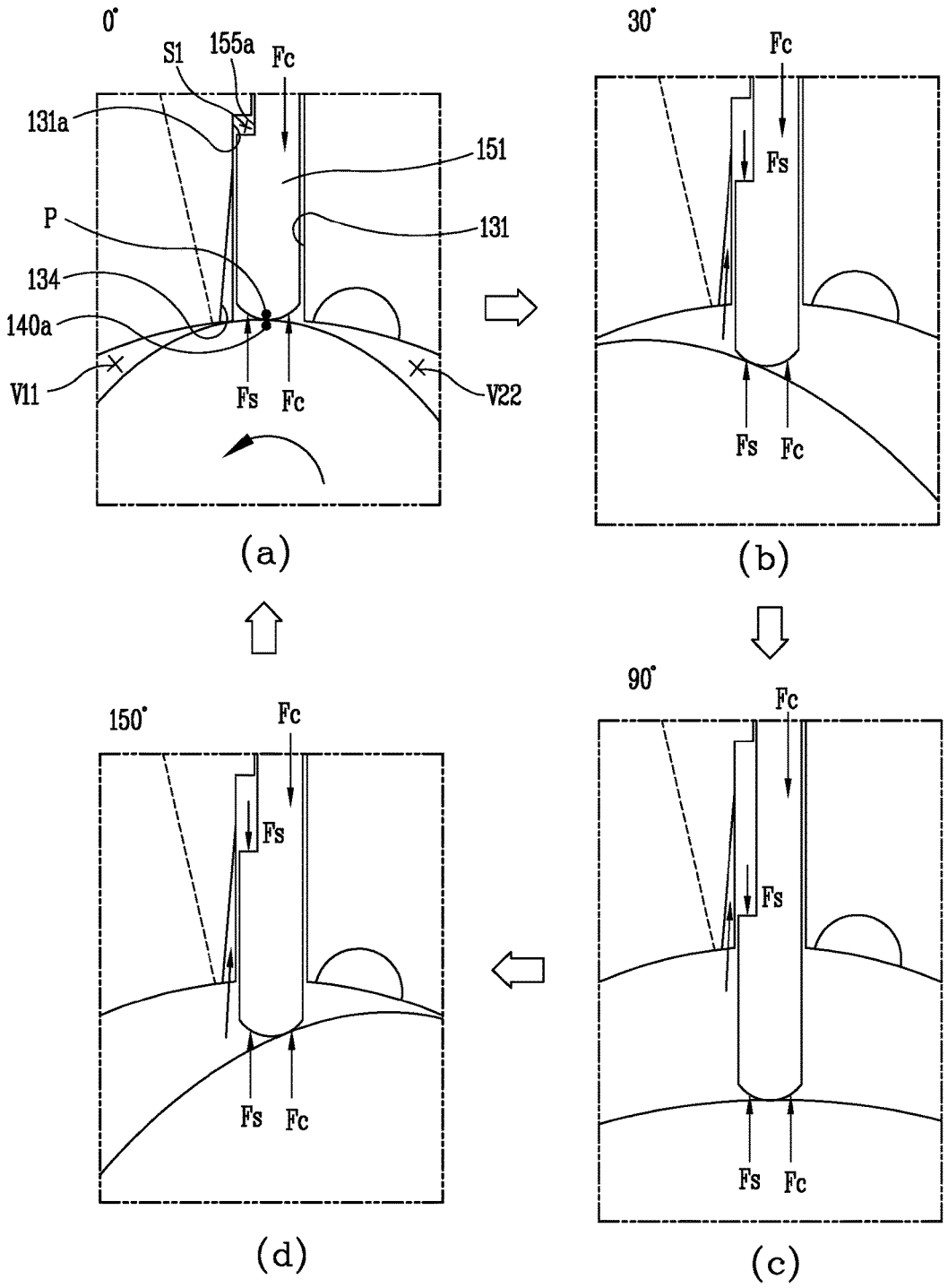
FIG. 8 is an transverse cross-sectional view illustrating a change between a vane and a vane slot according to a rotation angle of a roller in the compression section according to FIG. 5.

FIGS. 6 and 7 are an exploded perspective view and a coupled transverse cross-sectional view illustrating an embodiment of a vane and a vane slot in the compression section according to FIG. 5, and FIG. 8 is an transverse cross-sectional view illustrating a change between a vane and a vane slot according to a rotation angle of a roller in the compression section according to FIG. 5.

As illustrated in FIGS. 6 and 7, a rotary compressor according to the present embodiment may form an outer circumferential cross-sectional area (A1) of the first vane slot 131 to be smaller than an inner circumferential cross-sectional area (A2) to reduce a force applied to a rear end of the vane in a roller direction. As a result, a rear end cross-sectional area of the first vane 151 receiving a discharge pressure at a high pressure may be further reduced compared to a front end cross-sectional area thereof receiving a suction pressure at a relatively low pressure and a pressure of the compression chamber (intermediate pressure or discharge pressure). Accordingly, in the same pressure condition, compared to a vane in the related art in which a front end cross-sectional area (a front end of the vane body at which a vane protrusion which will be described later is started) and a rear end cross-sectional area of the vane are the same, a contact force between the vane and the roller according to the present embodiment may be decreased by a predetermined extent to reduce a mechanical friction loss between the vane and the roller.

To this end, according to the present embodiment, a slot side step portion 131*a* may be formed on one side surface of the first vane slot 131, and a vane side step portion 155*a* may be formed to correspond to the slot side step portion 131*a* on one side surface of the first vane body 155 corresponding to the slot side step portion 131*a*.

The slot side step portion 131*a* may be started from an inner circumferential open surface 130*c* of the first vane slot 131 and formed to be stepped by a predetermined length in the direction of an outer circumferential open surface 130*d*, and the vane side step portion 155*a* may be started from a rear end of the first vane body 155 and formed to be stepped by a predetermined length in a front end direction thereof. As a result, the outer circumferential cross-sectional area (A1) of the first vane slot 131 may be formed to be smaller than the inner circumferential cross-sectional area (A2) thereof, and a rear end cross-sectional area of the first vane body 155 may be formed to be smaller than a front end cross-sectional area thereof.

The slot side step portion 131*a* and vane side step portion 155*a* may be formed in a stepped manner in opposite directions to each other to form a gas accommodation portion (S1) constituting a type of damping space while varying a volume according to a moving direction of the first vane 151 between the slot side step portion 131*a* and the vane side step portion 155*a*.

The gas accommodation portion (S1) may be preferably formed to be communicated with a side of the suction chamber (first suction chamber) (V11) to form a suction pressure or intermediate pressure. If the gas accommodation portion (S1) is communicated with a side of the compression chamber (second compression chamber) (V22), then a contact force between the roller and the vane may be the same as that of the related art even when a rear end cross-sectional area (A1) of the vane decreases. Accordingly, the gas accommodation portion (S1) should be formed to be communicated with a side of the suction chamber.

Furthermore, the gas accommodation portion (S1) may be formed on both side surfaces as well as either one side surface based on the vane. However, when the gas accommodation portion (S1) is formed on both sides of the vane, the gas accommodation portion formed at a side of the compression chamber between the both gas accommodation portions may preferably form a communication passage on the main bearing or sub-bearing to be blocked from a high pressure portion or communicated with a low pressure portion.

A length of the vane side step portion 155*a* may be formed to the extent that the vane side step portion 155*a* is not exposed to the suction chamber (V11) in a state that the first vane 151 is protruded to the maximum, but the cylinder and vane should secure a minimum contact length, and thus a length (L1) of the vane side step portion 155*a* should be formed with a length of subtracting a sum value of a maximum protrusion amount (L3) and a front side minimum contact length (L4) from an entire vane length (L2).

Here, the maximum protrusion amount (L3) of the first vane 151 may be preferably formed to be 0.3-0.5 times smaller than the entire length (L2) of the first vane. If the maximum protrusion amount (L3) of the vane is smaller than 0.3 times of the entire vane length (L2), then the length of the vane may excessively increase to further require a rear space of the vane as well as increase a friction loss to the cylinder, and on the contrary, if the maximum protrusion amount (L3) of the vane is larger than 0.5 times thereof, then a support area to the cylinder 130 may decrease too much to generate refrigerant leakage.

Furthermore, a width directional length (D1) of the vane side step portion 155*a* is a value of subtracting a rear end width length (t2) from a front end width length (t1) of the first vane body 155, and should be preferably formed to be smaller than or equal to a half of the front end width length (t1) but larger than or equal to 0.3 times of the front end width length (t1). If the front end width depth (D1) is too large, then a rear end cross-sectional area may decrease to the extent to excessively reduce a contact force between the vane and the roller to generate refrigerant leakage at around 90°, and on the contrary, if the front end width depth (D1) is too small, then a contact force reduction effect may be insignificant. Accordingly, the width directional depth (D1) of the vane side step portion 155*a* may be preferably formed to be approximately 0.347 times of the front end width length (t1) (i.e., $D1 \leq 0.347 \times t1$).

Here, a rear end cross-sectional area (A1) of the first vane body 155 may be preferably formed to be the same as a value of subtracting the width directional depth (D1) of the vane side step portion 155*a* from a front end cross-sectional area (A2) in the aspect of processing or sealing to allow both side surfaces of the first vane body 155 to form a vertical plane with respect to a width direction.

Furthermore, since the slot side step portion 131*a* should correspond to the vane side step portion 155*a*, a depth (D2) of the slot side step portion 131*a* may be formed to be the same as a depth (D1) of the vane side step portion 155*a*. However, a length (L5) of the slot side step portion 131*a* should be formed to be larger or equal to a sum value of the maximum protrusion amount (L3) of the first vane 151 and a minimum contact length (i.e., a front side minimum sealing length between the vane and the cylinder) (L4) of the cylinder. Otherwise, a step surface of the slot side step portion 131*a* may collide with a step surface of the vane side step portion 155*a* at the moment when the roller reaches a position of 0° or 180°, and the first vane (and the second vane) may not be completely inserted into the vane slot, thereby excessively increasing a contact force between the roller and the vane or preventing the rotation of the roller.

Here, a front side minimum sealing length of the cylinder may be the same as the minimum contact length (L4), and may be formed as approximately 3.0 mm though there is a difference according to the compressor capacity. For reference, a rear side minimum contact length (L6) may be formed to be approximately the same as or larger than a front side minimum contact length (L5).

On the other hand, the gas accommodation portion (S1) may be sealed or always open. However, when the gas accommodation portion (S1) is sealed, an internal pressure of the gas accommodation portion (S1) may form an intermediate pressure, and thus a rear end cross-sectional area (A1) of the vane slot should be formed to be smaller, and when the gas accommodation portion (S1) is open, the internal pressure of the gas accommodation portion (S1) may form a suction pressure, and thus the rear end cross-sectional area (A1) of the vane slot may be formed in a relatively broad manner compared to the foregoing sealed case.

Here, a communication passage 134 for introducing the refrigerant of the suction chamber (V11) into the gas accommodation portion (S1) may be formed at an inner circumferential open surface edge of the first vane slot 131. As a result, the gas accommodation portion (S1) may be always open with respect to the suction chamber (V11).

The communication passage 134 may be formed at a position in which the suction chamber (V11) and the gas accommodation portion (S1) are always open. However, according to circumstances, The compressor of claim 1, the communication passage 134 may not be communicated with the gas accommodation portion (S1) from a rotation angle of the roller of 0° to a predetermined rotation angle by adjusting an outlet position of the communication passage 134 or adjusting an end position of the vane side step portion 155*a*.

As illustrated in FIGS. 6 and 7, the communication passage 134 may be formed in a groove shape or formed in a chamfer shape at an inner circumferential edge of the first vane slot 131. However, in order to secure a minimum sealing area between the vane and the cylinder, an outlet side cross-sectional area of the communication passage formed on an inner surface of the vane slot may be formed to be equal to or less than an inner circumferential sealing area excluding the outlet side cross-sectional area of the communication passage.

Furthermore, the communication passage 134 may be formed at both upper and lower ends of an edge of the inner circumferential open surface 130*c*, respectively or formed only at either one of the both upper and lower ends thereof according to circumstances.

Furthermore, though not shown in the drawing, the communication passage may be formed in a groove or hole shape toward a side surface of the first vane slot from an inner circumferential end portion of the suction port.

The process of decreasing a contact force between the roller and the vane in a compressor according to the present embodiment will be described below.

In other words, as illustrated in FIG. 8A, assuming that a time point at which an end 140*a* of the roller 140 in a major axis direction is brought into contact with the center point (P) of the first vane 151 is 0°, when a rotation angle of the roller 140 is 0°, the first vane 151 is inserted into the first vane slot 131 in a state that the first vane protrusion 156 is brought into contact with an outer circumferential surface of the roller 140. Here, a volume of the gas accommodation portion (S1) is a minimum volume, and the gas accommodation portion (S1) is communicated with the suction chamber (V11) through the communication passage 134, and thus the gas accommodation portion (S1) forms a suction pressure.

Then, as illustrated in FIG. 8B, when the roller 140 starts rotation in a counter-clockwise direction, the first vane 151 starts being protruded from the first vane slot 131 in a state of being brought into contact with an outer circumferential surface of the roller 140. Here, the volume of the gas accommodation portion (S1) increases while the vane side step portion 155*a* moves in a roller direction along the first vane 151. Moreover, the refrigerant of the suction chamber (V11) is introduced into the gas accommodation portion (S1) through the communication passage 134, and thus the gas accommodation portion (S1) still maintains the suction pressure.

Furthermore, as illustrated in FIG. 8C, while the roller 140 rotates up to 90°, the first vane 151 is continuously protruded, and protruded to the maximum at a rotation angle of the roller 140 of 90°, and as illustrated in FIGS. 8D and 8A, a protrusion amount of the first vane 151 decreases while the roller 140 rotates up to 180° again, and the first vane 151 is completely inserted into the first vane slot 131. Here, the vane side step portion 155*a* moves in an opposite direction of the roller 140 along with the first vane 151 to decrease a volume of the gas accommodation portion (S1), but the refrigerant of the suction chamber is introduced into the gas accommodation portion (S1) to still form a suction pressure. Accordingly, it may be possible to significantly reduce a mechanical friction loss between the roller and the vane while decreasing a contact force between the roller and the vane.

Figure 13:
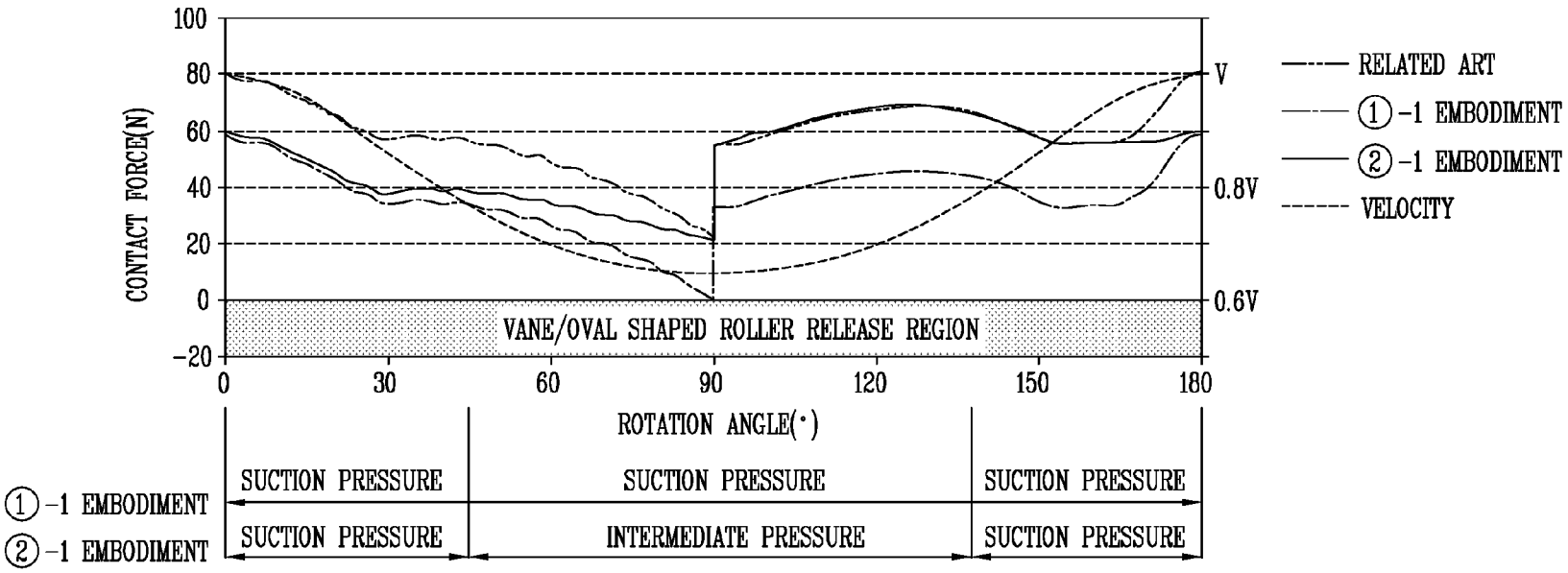
FIGS. 13 and 14 illustrate graphs in which a change of contact force is compared with the related art in an embodiment according to FIG. 6 and an embodiment according to FIG. 9.
Figure 14:
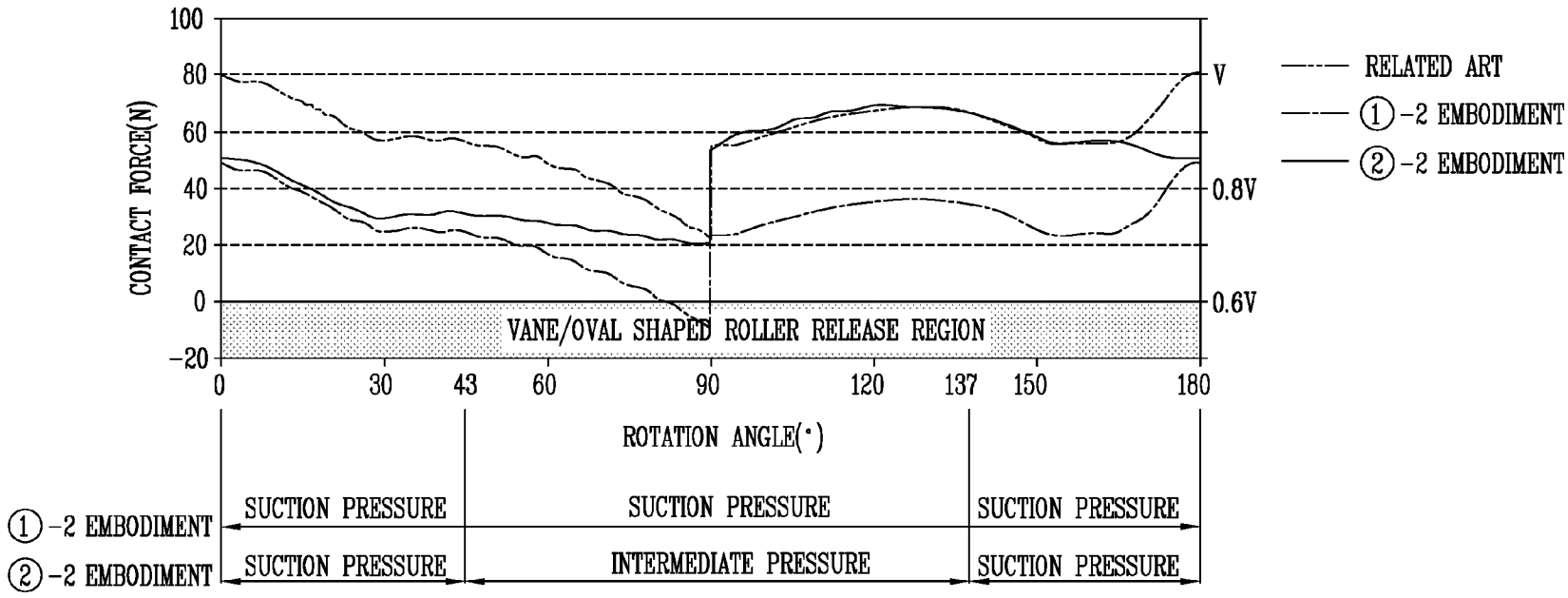

FIGS. 13 and 14 are graphs in which a contact force between a vane and a roller according to a rotation angle of an oval shaped roller is compared with the related art in a rotary compressor according to the present embodiment, wherein FIG. 13 is a graph in which a depth of the vane side step portion 155*a* is 0.347 times of a width of the vane, and FIG. 14 is a graph in which a depth of the vane side step portion 155*a* is 0.5 times of a width of the vane.

Referring to FIG. 13, a vane in the related art without the vane side step portion 155*a* has the largest contact force of 80 N at rotation angles of 0° and 180°, and has the smallest contact force of 20 N at a rotation angle of 90°, and the contact force thereof gradually decreases from 0° to 90°, but rapidly increases at 90° and gradually (in a rolling manner) increases up to 180°.

However, according to the present embodiment (Embodiment ①-1), the contact force decreases to 60 N (which is smaller than that of the related art) compared to the related art. As the contact force decreases during a section (in the vicinity of 0° and 180°) in which the linear velocity is high, it may be possible to reduce a mechanical friction loss between the roller and the vane. Furthermore, the contact force gradually decreases or gradually increases from 0° to 90° and from 90° to 180°, and in particular, at 90° in which the linear velocity is the smallest, the contact force significantly decreases compared to the related art, and approaches almost zero. As a result, according to the present embodiment compared to the related art, the contact force may decrease for most of the section to reduce a friction loss between the roller and the vane, thereby increasing an efficiency of the rotary compressor to which an oval shaped roller is applied.

On the contrary, referring to FIG. 14, the related art is similar to a case of FIG. 13, but according to the present embodiment (Embodiment ①-2), contact forces at angles of 0° and 180° decrease to 50 N which is smaller than the related art, respectively, compared to the related art. As a result, it may be possible to further reduce a friction loss during the section compared to the foregoing embodiment (Embodiment ①-1), thereby increasing the compressor efficiency. Furthermore, a contact force from 0° to 90° and from 90° to 180° gradually decreases or gradually increases, and in particular, the contact force at 90° rather excessively decreases contrary to the foregoing embodiment (Embodiment ①-1) to generate a release phenomenon between the vane and the roller in which the vane is separated from the roller 140.

Taking this into consideration, the following embodiment may be presented to suppress a phenomenon in which the vane and the roller are separated during a specific section.

In other words, according to the foregoing embodiment, the communication passage 134 is formed to always communicate with the suction chamber (excluding the vicinity of 0° and 180°), but according to the present embodiment, the communication passage is formed to allow the gas accommodation portion to selectively communicate with the suction chamber. Through this, according to the present embodiment, the gas accommodation portion and the suction chamber are blocked in the vicinity of rotation angles of the roller of 90°, and the gas accommodation portion forms a type of back pressure chamber while forming an intermediate pressure at a rotation angle at which a contact force between the roller and the vane is weakened.

Figure 9:
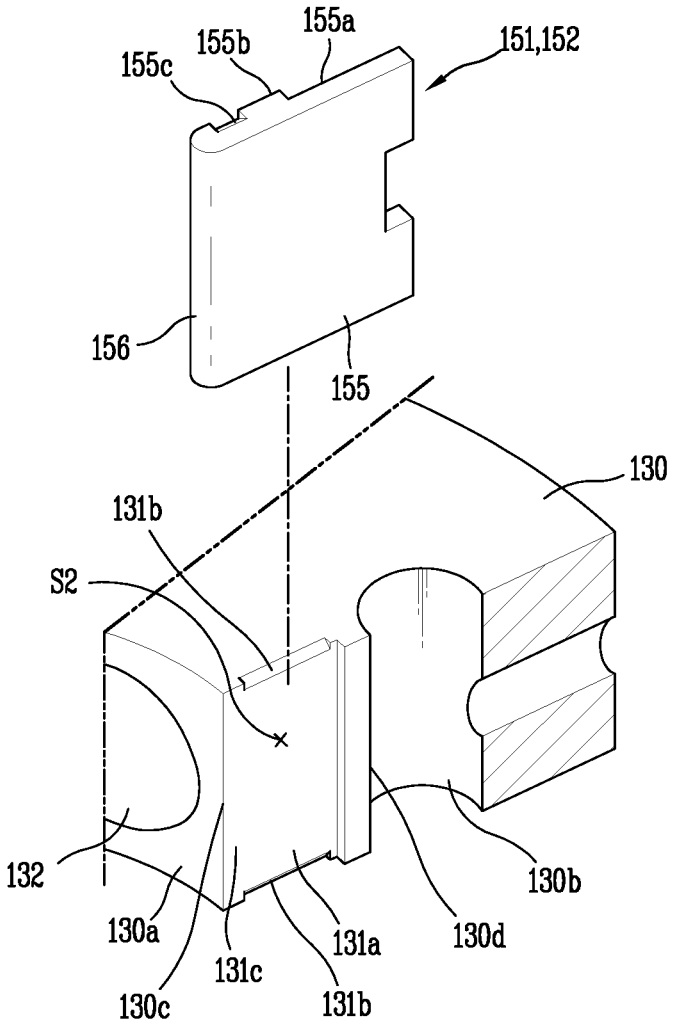
FIG. 9 is an exploded perspective view illustrating another embodiment of a vane and a vane slot in the compression section according to FIG. 5.
Figure 10:
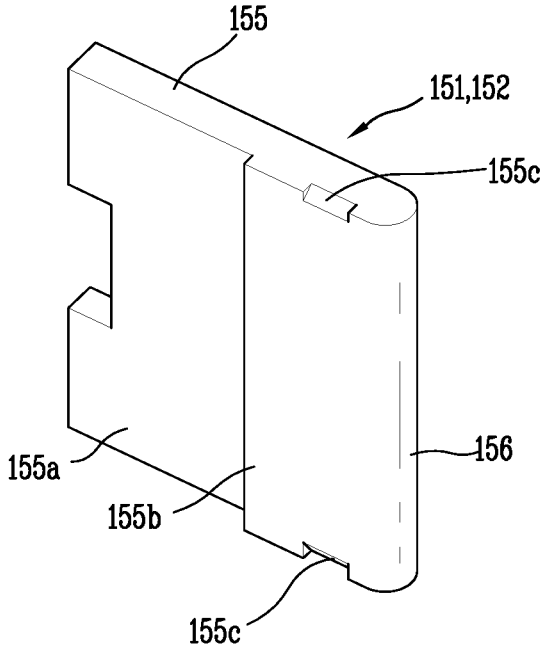
FIG. 10 is a perspective view illustrating that the vane in FIG. 9 is seen from another side.
Figure 11:
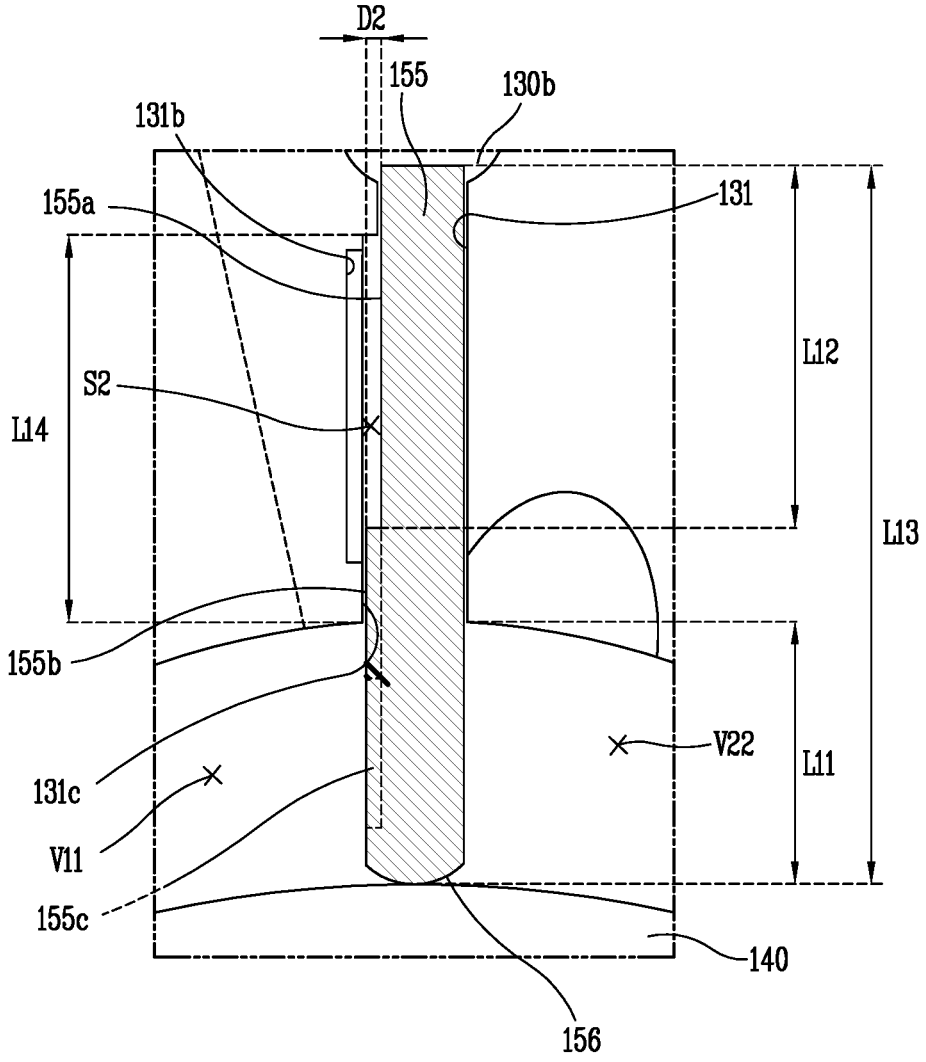
FIG. 11 is a transverse cross-sectional view illustrating a configuration in which the vane and the vane slot according to FIG. 9 are coupled to each other.
Figure 12:
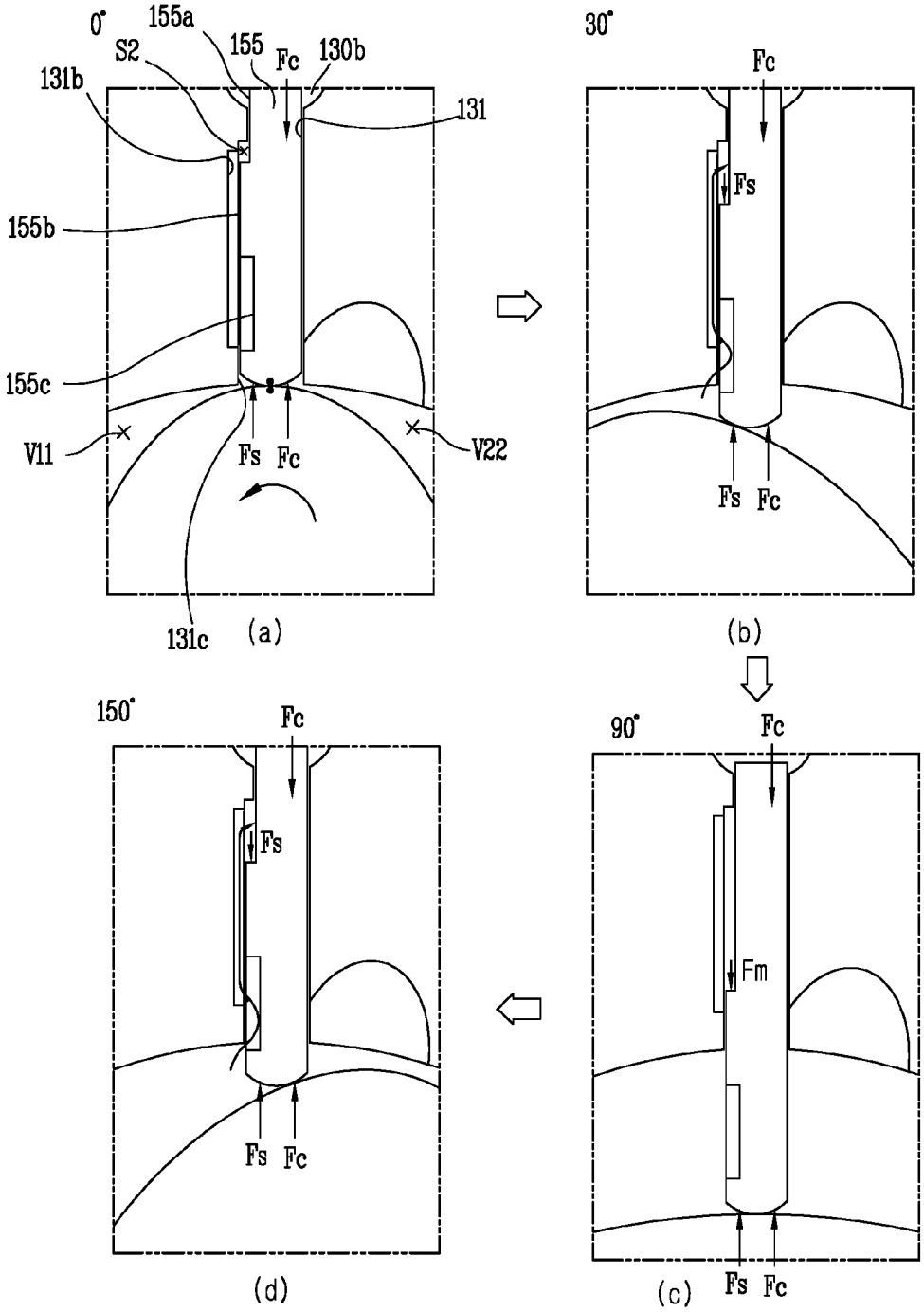
FIG. 12 is a transverse cross-sectional view illustrating a change between the vane and the vane slot according to a rotation angle of a roller in the vane and the vane slot according to FIG. 9.

FIG. 9 is an exploded perspective view illustrating another embodiment of a vane and a vane slot in the compression section according to FIG. 5, and FIG. 10 is a perspective view illustrating that the vane in FIG. 9 is seen from another side, and FIG. 11 is a transverse cross-sectional view illustrating a configuration in which the vane and the vane slot according to FIG. 9 are coupled to each other, and FIG. 12 is a transverse cross-sectional view illustrating a change between the vane and the vane slot according to a rotation angle of a roller in the vane and the vane slot according to FIG. 9.

As illustrated in FIGS. 9 and 10, the foregoing vane side step portion 155*a* may be formed on one side surface of the suction portion of the first vane 151, and a vane side sealing portion 155*b* may be formed on a front end side surface than the vane side step portion 155*a*, and a vane side communication groove 155*c* may be formed in a stepped or chamfer manner at either one of both a top and a bottom edge or both a top and a bottom end of the vane side sealing portion 155*b*.

The vane side communication groove 155*c* may allow the suction chamber (V11) to communicate with a slot side communication groove 131*b* to allow the suction chamber (V11) to communicate with a gas accommodation portion (S2) for a specific range of section. For example, for the vane side communication groove 155*c* and slot side communication groove 131*b*, it may be preferably formed to communicate between the suction chamber (V11) and the gas accommodation portion (S2) at rotation angles of 0° and 180° at a portion in which a linear velocity between the roller 140 and the vane 151 is the highest, whereas it is formed to block between the suction chamber (V11) and the gas accommodation portion (S2) at a rotation angle of 90° at a portion in which the linear velocity is the lowest.

Furthermore, the foregoing slot side step portion 131*a* may be formed on one side surface of the first vane slot 131 of the cylinder 130, and the slot side communication groove 131*b* selectively communicated with the suction chamber (V11) for a specific range of section through the vane side communication groove 155*c* at either one of both a top and a bottom edge or both a top and a bottom end of the slot side step portion 131*a*. The slot side communication groove 131*b* may be formed in a stepped or chamfer shape.

Furthermore, if the slot side communication groove 131*b* is communicated with the vane side communication groove 155*c* in a set range of rotation angle, then a radial directional length of the slot side communication groove 131*b* may be formed to be smaller than that of the slot side step portion 131*a*. As a result, a slot side sealing portion 131*c* facing the vane side sealing portion 155*b* may be formed at a front end of the slot side step portion 131*a*. A radial directional length (L7) of the vane side sealing portion 155*b* may be formed to be smaller than a radial directional length (L8) of the slot side communication groove 131*b*, and a radial directional length (L9) of the slot side sealing portion 131*c* may be formed to be smaller than the radial directional length (L7) of the vane side sealing portion 155*b*.

In other words, when the vane side sealing portion 155*b* is located within a range of the slot side communication groove 131*b*, the slot side communication groove 131*b* may perform the role of forming a space (or gap) to introduce refrigerant into the gas accommodation portion (S2) through the vane side sealing portion 155*b*.

Here, the gas accommodation portion (S2) capable of varying a volume when the first vane 151 moves in a radial direction may be formed on the vane side step portion 155*a* and slot side step portion 131*a*, and the vane side communication groove 155*c* may be formed to communicate with the slot side communication groove 131*b* or to be separated and blocked therefrom according to the extent of the movement of the first vane 151.

As illustrated in FIGS. 12A and 12B, the vane side communication groove 155*c* and slot side communication groove 131*b* may communicate with each other when a rotation angle of the roller 140 is from around 0° to a predetermined first rotation angle (for example, any rotation angle within a range between 30° and 60°) whereas as illustrated in FIG. 12C, the gas accommodation portion (S2) is blocked from the suction chamber (V11) in a range from a first rotation angle to 90°. Of course, as illustrated in FIGS. 12D and 12A, they operate from 90° to 180° in a symmetrical manner to rotation angles between 0° and 90°, and thus the detailed description thereof will be omitted.

When a rear end width of the first vane 151 corresponding to a cross-sectional area (A1) of an outer circumferential open end 130*c* of the first vane slot 131 is formed to be less than a predetermined value (for example, when a depth (D2) of the vane side step portion 155*a* is 0.5 times of a rear end width length (t2) of the vane or greater than that), a rear end cross-sectional area (A1) of the first vane 151 receiving a force in a direction in which the roller is brought into contact with the vane may decrease, and thus an entire contact force between the roller 140 and the vane may be weakened, and therefore, the vane may be instantaneously released from the roller 140, in particular, in the vicinity of rotation angles of 90° which has the lowest contact force.

However, as illustrated in FIG. 12C, for a specific range of rotation angle (around 90°) the suction chamber (V11) is blocked between the suction chamber (V11) and the gas accommodation portion (S2) while the vane side sealing portion 155*b* overlaps with the slot side sealing portion 131*c* to form an intermediate pressure. Then, a sum force (Fc+Fm) of a discharge pressure of the casing 10 and an intermediate pressure of the gas accommodation portion (S2) applied to a rear end 151*c* of the first vane 151 is added in the direction of the roller 140. Then, it may be possible to suppress the first vane 151 from being released from the roller 140, and prevent refrigerant compressed in the compression chamber (V22) from being leaked to the suction chamber (V11), thereby enhancing the compressor efficiency.

Referring to FIG. 13, when a depth (D2) of the vane side step portion 155*a* satisfies a relationship equation of D2=0.347×t1 for a front end width length (t1) of the vane, it may be possible to significantly increase the compressor efficiency compared to the foregoing embodiment (Embodiment ①-1) as well as the related art. In other words, according to the present embodiment (Embodiment ②-1) in which the vane side communication groove 155*c* and slot side communication groove 131*b* are formed on the vane and the cylinder in addition to the vane side step portion 155*a* and slot side step portion 131*a*, a contact force similar to the foregoing embodiment (Embodiment ①-1) is shown in the vicinity of rotation angles of 0° through 30°, and 180°.

However, it is seen that the contact force is significantly reduced when compared to the foregoing embodiment (Embodiment ①-1) at rotation angles of 30° through 90°, and between 90° and 180°. As a result, according to the present embodiment (Embodiment ②-1), it may be possible to significantly enhance the compressor efficiency compared to the foregoing embodiment (Embodiment ①-1) as well as the related art.

Furthermore, referring to FIG. 14, even when a depth (D2) of the vane side step portion 155*a* satisfies a relationship equation of D2=0.5×t1 for a front end width length (t1) of the vane, according to the present embodiment (Embodiment ②-2), it may be possible to significantly increase the compressor efficiency compared to the foregoing embodiment (Embodiment ①-2) as well as the related art as illustrated above in FIG. 13. In particular, in case of the according to the present embodiment (Embodiment ①-2), it may be possible to generate a release phenomenon of the vane and the roller 140 in the vicinity of rotation angles of 90°, but in case where the vane side sealing portion and the slot side sealing portion are formed to overlap with each other to seal the gas accommodation portion (S1) for a specific section (a section of rotation angles of 80-90°) as illustrated in the present embodiment, the gas accommodation portion (S2) may compensate a contact force to the extent of reducing an area of a rear end 151*d* of the vane while the gas accommodation portion (S2) forms an intermediate pressure (Pm). Accordingly, a force (Rm) due to a pressure of the gas accommodation portion (S2) may be further added to increase the contact force, in particular, in the vicinity of rotation angles of 80-90°, during which a contact force between the roller and the vane is weakened, and thereby the contact force may be maintained at approximately 20 N as illustrated in FIG. 14 to prevent the leakage of refrigerant.

As described above, in order to allow the gas accommodation portion (S2) to communicate with the suction chamber to form a suction pressure atmosphere in a specific range of rotation angles while at the same sealing the gas accommodation portion (S2) to form an intermediate pressure atmosphere in another range of rotation angles, a relationship among a length (L10) of the vane side communication groove, a maximum protrusion amount (L11) of the vane, a depth (D2) and length (L12) of the vane side step portion, a length (L8) of the slot side communication groove, a length (L7) of the vane side sealing portion, a length (L9) of the slot side sealing portion and the like may be taken into consideration.

In other words, the maximum protrusion amount (L11) of the first vane may be formed to be greater than the length (L10) of the vane side communication groove, and less than or equal to a specific constant multiplied by an entire length (L13) of the vane (the specific constant is typically 0.4 when a minimum length at which the vane is inserted into the vane slot is greater than ½ times of an entire length of the vane).

Furthermore, the length (L10) of the vane side communication groove may be formed to be less than or equal to the maximum protrusion amount (L11) of the first vane, and the length (L8) of the slot side communication groove may be formed to be less than or equal to a value of subtracting the length (L9) of the slot side sealing portion from a length (L14) of the slot side step portion.

Furthermore, the length (L14) of the slot side step portion of the cylinder may be formed to be greater than the maximum protrusion amount (L11) of the vane. Here, a micro communication passage (not shown) may be formed on the slot side sealing portion 131*c* to supply a suction pressure or intermediate pressure according to a rotation angle to the gas accommodation portion (S2).

Furthermore, a minimum sealing length of the slot side sealing portion may differ according to a compressor capacity, but may be formed at approximately 3.0 mm.

On the other hand, another embodiment for reducing a contact force between the roller 140 and the vane in a compressor according to the present disclosure will be described below.

Figure 15:
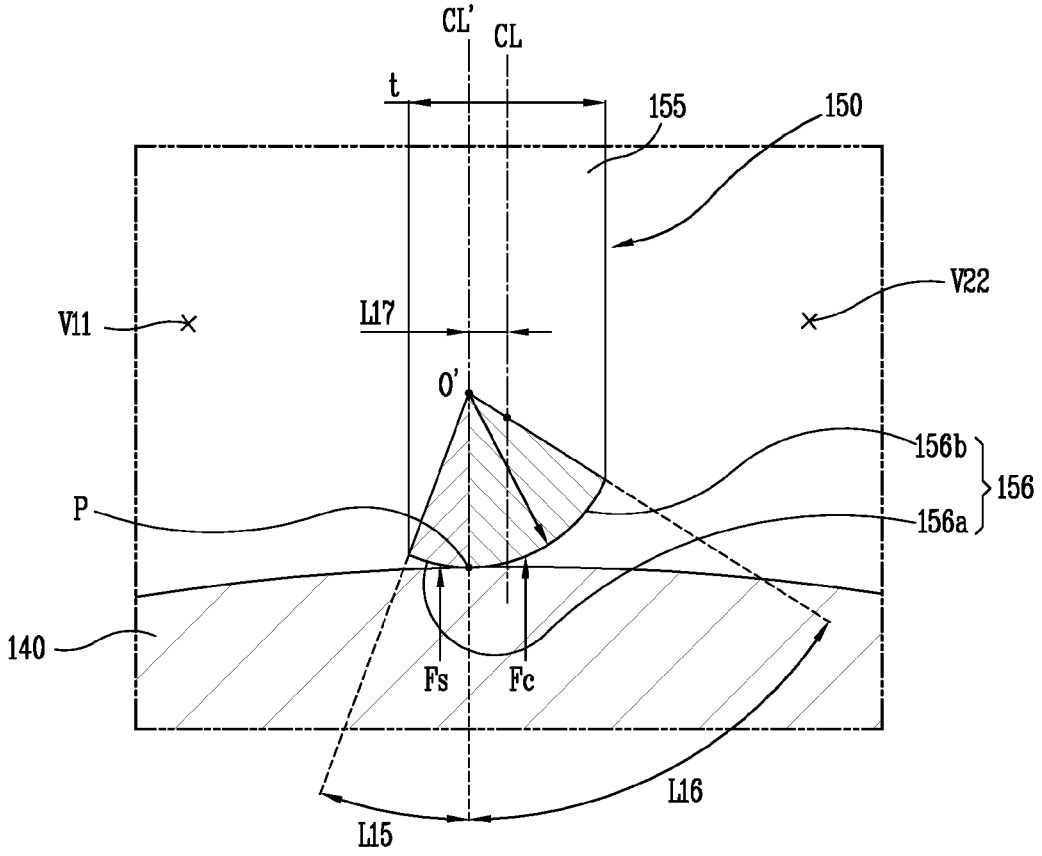
FIG. 15 is a cross-sectional view illustrating another embodiment of a vane in the compressor according to FIG. 3.
Figure 16:
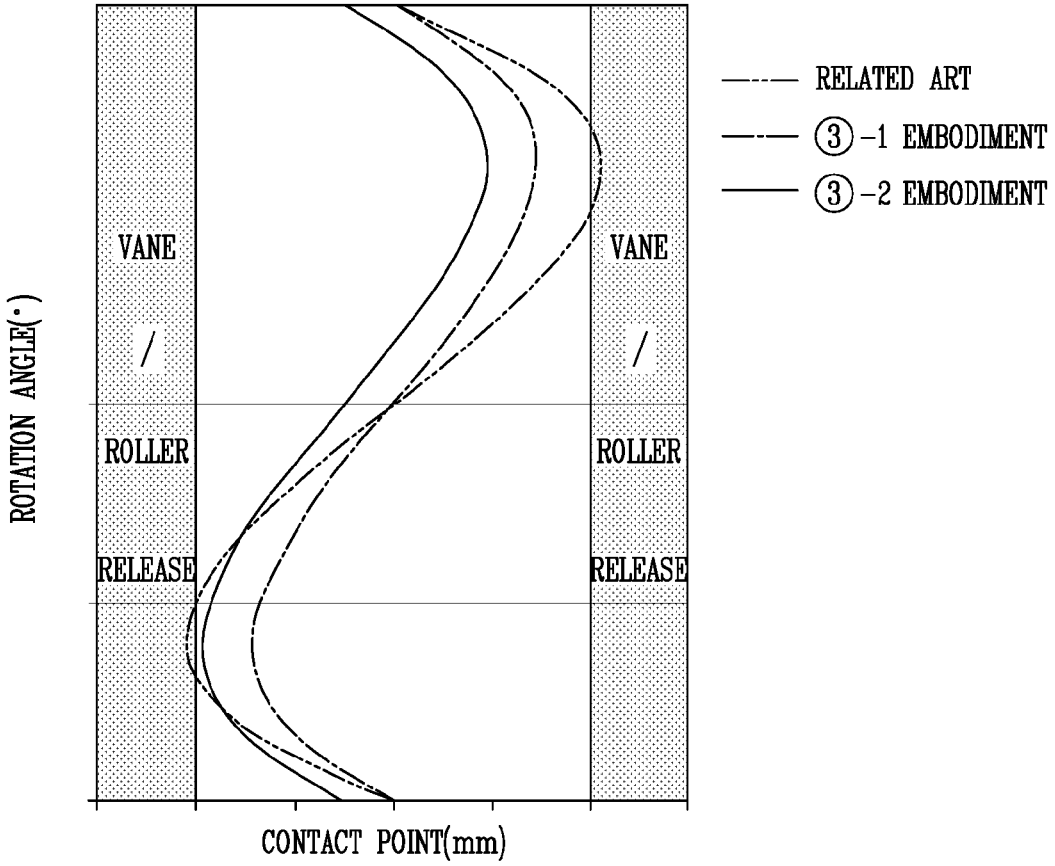
FIG. 16 illustrates a graph in which a contact state between a vane and a roller is compared with a vane in the related art when the vane according to FIG. 15 is applied thereto.

FIG. 15 is a cross-sectional view illustrating another embodiment of a vane in the compressor according to FIG. 3, and FIG. 16 illustrates a graph in which a contact state between a vane and a roller is compared with a vane in the related art when the vane according to FIG. 15 is applied thereto.

In other words, according to the foregoing embodiments, a rear end cross-sectional area may be formed to be smaller than a front end cross-sectional area to reduce an area receiving a force in a roller direction by a vane, but according to the present embodiment, the vane may be pushed in a rear end direction by increasing a pressure applied to the front end of the vane to decrease a contact force between the roller and the vane. In other words, a drag force to a back pressure applied to a front end of the vane may be increased to reduce a contact force between the roller and the vane.

For the purpose of this, as illustrated in FIG. 15, according to the present embodiment, the center (0') of a curvature radius of the vane protrusion may be formed to be eccentrically located to a predetermined extent in a direction of the suction chamber from a length directional center line (CL) passing through a width directional center of the vane.

In other words, the first vane protrusion 156 of the present embodiment may include a first curved portion 156*a* formed at a side of the suction chamber around a contact point (P) and a second curved portion 156*b* formed at a side of the compression chamber. Here, according to the foregoing embodiments, the first curved portion 156*a* and second curved portion 156*b* may be formed to have the same arc length around the contact point (P), but according to the present embodiment, an arc length (L16) of the second curved portion 156*b* may be formed to be greater than an arc length (L15) of the first curved portion.

As a result, compared to the foregoing embodiments in which a contact point is formed in the middle of a circumference length of the first vane protrusion 156, according to the present embodiment, an area facing the compression chamber (V22) may be enlarged to reduce a contact force between the vane and the roller to that extent while increasing a force (Fs+Fc) applied in a rear end direction of the first vane 151, thereby increasing the compressor efficiency.

When the present embodiment is applied thereto along with the foregoing embodiments, it may be possible to further reduce a contact force between the vane and the roller to further increase the compressor efficiency to that extent. However, when the present embodiment is applied thereto along with the foregoing embodiments, a release phenomenon may occur in which the vane is separated from the roller 140 for a partial rotation angle section (for example, around 90°). Accordingly, as illustrated in FIGS. 9 through 12, the gas accommodation portion formed between the vane and the vane slot may perform the role of a type of back pressure chamber to increase a contact force between the vane and the roller for a section in which the vane is released from the roller using a pressure of the gas accommodation portion, thereby preventing the vane and roller from being separated from each other to prevent the compressor efficiency from being reduced.

In case of the above example, an eccentricity of the roller 140 may be preferably formed to be greater than or equal to about 0.7 or less than or equal to 0.8.

Furthermore, a curvature radius (R) of the first vane protrusion 156 may be formed to be greater than or equal to a half of a width of the first vane body 155 and less than two times of the width.

Furthermore, a distance between a virtual line (CL') extending the center of a curvature radius (R) of the first vane 151 in a length direction and a length directional center line (CL) thereof, namely, a distance (L17) over which the contact point (P) moves may be formed to be greater than zero and less than or equal to a half of a value of subtracting a width length (t) from two times of a curvature radius (R) of the first vane protrusion 156. In other words, when a distance between a virtual line (CL') extending the center of a curvature radius in a length direction of the vane body and a length directional center line (CL) of the vane is L17, and a curvature radius of the vane protrusion is R, and a width of the vane is t, it may be formed to satisfy $0 \leq L17 \leq (2R-t)/2$.

The working effect of the foregoing rotary compressor according to the present embodiment will be described as follows.

In other words, referring to FIG. 16, when the center (0) of a curvature radius is located on a length directional center line (CL) of the vane and the curvature radius (R) is greater than a width (t) of the vane (related art), it is seen that a release section (in the vicinity of 45° and 135°) between the vane 150 and the roller 140 occurs. However, when the center (0) of a curvature radius is located on a length directional center line (CL) of the vane and the curvature radius (R) is equal to a width (t) of the vane (Embodiment ③-1), it is seen that the vane is not released from the roller over the entire section. Furthermore, when the center (0') of a curvature radius is eccentrically located to a side of the suction chamber from a length directional center line (CL) of the vane and the curvature radius (R) is equal to a width of the vane (Embodiment ③-2), it is seen that a contact point between the vane and the roller is lowered over the entire section compared to the Embodiment ③-1.

On the other hand, all the foregoing embodiments may be also applicable in the same manner to a typical rotary compressor with a circular shaped roller. The basic configuration and working effects thereof are substantially the same as the foregoing embodiments and thus the detailed description thereof will be omitted.

However, when the roller is integrally formed into the rotating shaft while a circular roller is applied thereto to remove rotation, it may be possible to enhance a mechanical friction loss by approximately 30% compared to a case where the roller rotates with respect to an outer circumferential surface of the rotating shaft (more particularly, an outer circumferential surface of the eccentric portion).

In other words, when the roller is inserted into the eccentric portion to allow the roller to rotate, a friction loss may occur between the roller and the eccentric portion of the rotating shaft to reduce the compressor efficiency, but when the roller is integrally formed into the rotating shaft as illustrated in the present embodiment, a friction loss between the roller and the rotating shaft may be removed to enhance the compressor efficiency while suppressing a friction loss of the entire compressor.

However, when a circular roller is coupled to the rotating shaft in a condition that a diameter and a height of the cylinder are the same, it may be possible to increase a friction loss between the roller and the vane. Accordingly, a back pressure applied to a rear surface of the vane may be appropriately supplied or a drag force applied to the vane protrusion may be increased to reduce a friction loss between the roller and the vane.

Figure 17:
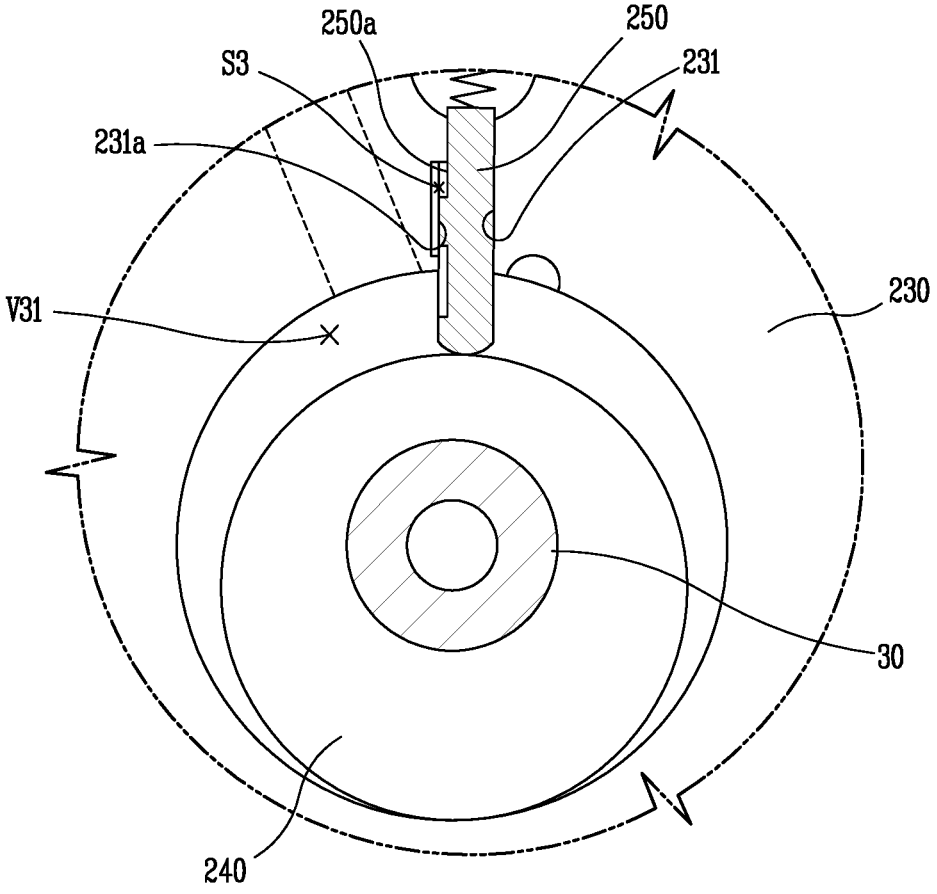
FIGS. 17 and 18 are plan views illustrating embodiments for a shape of a vane when a circular roller is integrally formed into a rotating shaft in a rotary compressor according to the present disclosure.

For example, as illustrated in FIG. 17, a circular roller 240 may be integrally formed into the rotating shaft 30, and a vane 250 brought into contact with an outer circumferential surface of the circular roller 240 may form step portions 231*a*, 250*a*, respectively, corresponding to each other along with a vane slot 231. A guide sheet portion (S3) communicating with a suction chamber (V31) of a cylinder 230 may be formed between the step portions. Then, a rear end cross-sectional area of the vane 250 inserted into the vane slot 231 as well as the vane slot 231 may be formed to be smaller than a rear end cross-sectional area thereof.

As a result, a contact force between the circular roller 240 and the vane 250 may decrease while a back pressure received at a rear end of the vane 250 decreases as described above, and therefore, it may be possible to suppress an increase of a friction loss between the circular roller 240 and the vane 250 even in a state that a friction loss between the circular roller 240 and the rotating shaft 30 is removed. Consequently, a mechanical friction loss of the entire compressor may be decreased to enhance the compressor efficiency.

Figure 18:
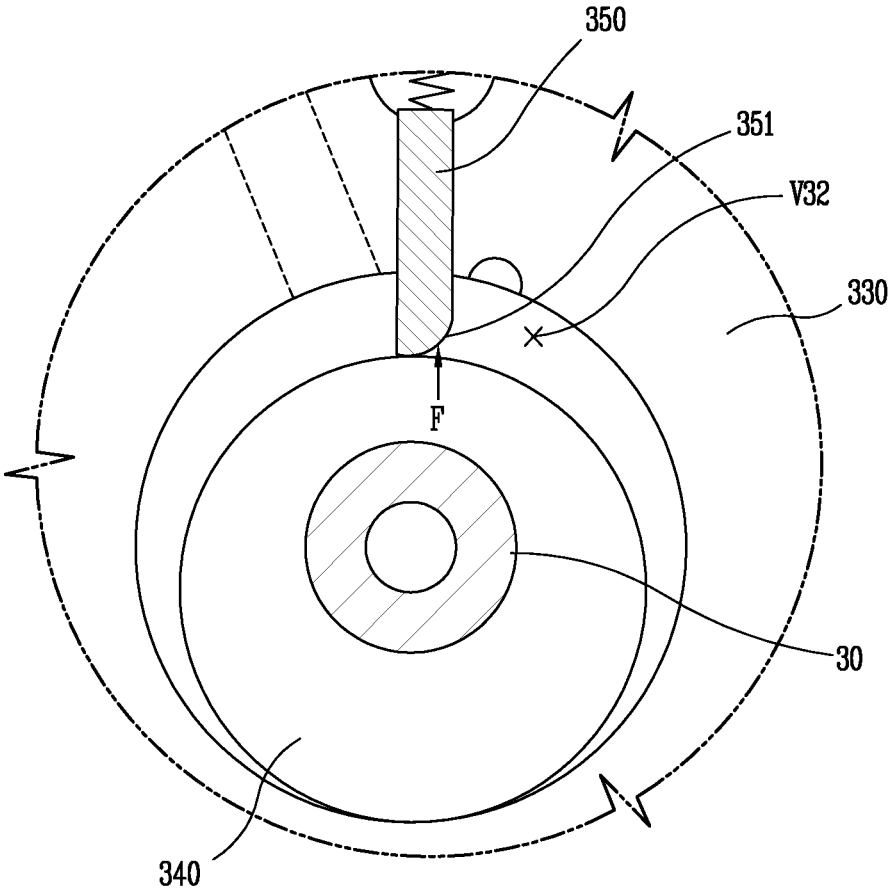

Furthermore, as illustrated in FIG. 18, a circular roller 340 may be integrally formed into the rotating shaft 30, and a front end of a vane 350, namely, a vane protrusion 352, brought into contact with an outer circumferential surface of the circular roller 340, may be formed in an asymmetric shape in which an area at a side of the compression chamber (V32) is relatively large as illustrated in FIG. 15. Then, an area receiving a pressure of the compression chamber (V32) may be enlarged to increase a drag force (F) to a back pressure applied from a rear side of the vane to a front side thereof.

Through this, a contact force between the roller and the vane may be decreased to suppress an increase of a friction loss between the roller and the vane even in a state that a friction loss between the roller and the rotating shaft is removed. Accordingly, a mechanical friction loss of the entire compressor may be decreased to enhance the compressor efficiency.

On the other hand, when a contact force between the roller and the vane increases, a friction loss between the vane and a vane slot into which the vane is inserted may increase at the same time to further reduce the efficiency of the compressor.

In particular, when a maximum protrusion amount of the vane increases compared to a case of a circular roller in the related art as the roller is formed in an oval shape, a side directional gas force (Fside) received from the compression chamber by the vane may also increase at the same time, and due to this, a reaction force between the cylinder and the vane may increase to further increase a mechanical friction loss between the cylinder and the vane, thereby further reducing the compression efficiency.

Accordingly, according to the present embodiment, a space portion may be formed to generate a counterforce (Fgas) of a discharge pressure between the vane slot and a suction side surface of the vane, thereby cancelling a side directional gas force (Fside) to reduce a reaction force received by both side surfaces of the vane. Through this, it may be possible to suppress the cylinder and the vane from being excessively adhered to each other therebetween, thereby reducing a friction loss between the cylinder and the vane.

Here, the space portion may be formed to act on both a first vane and a second vane, and thus hereinafter, a space portion formed in the first vane will be described as a representative example. Accordingly, the "vane" may refer to a first vane, but in actuality, may include both a first vane and a second vane.

Figure 19:
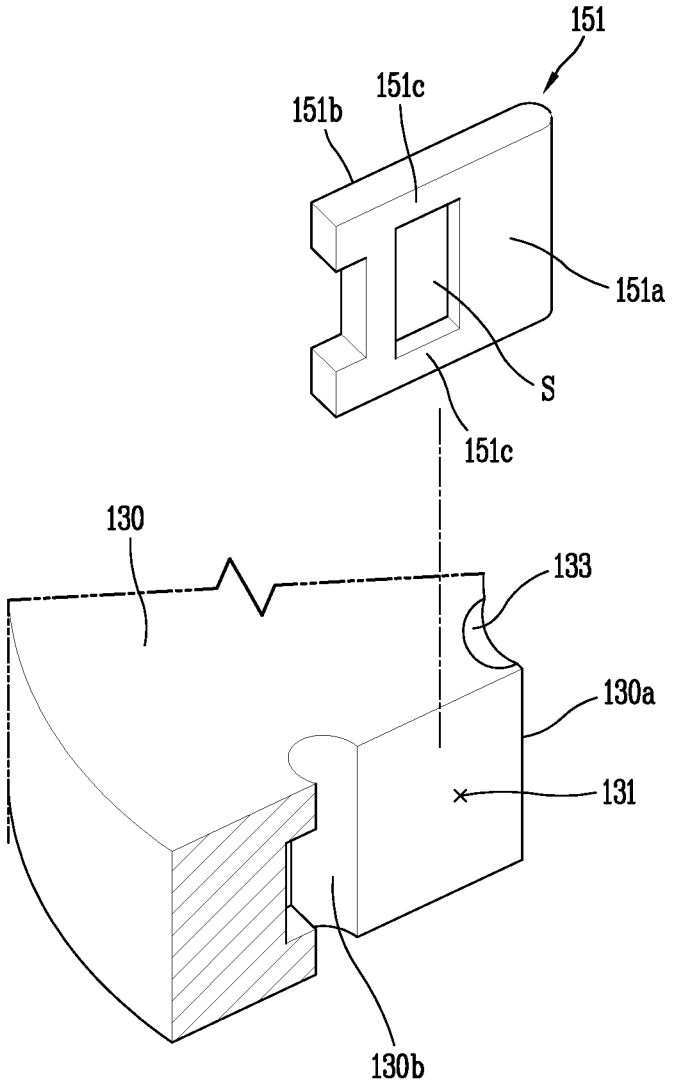
FIGS. 19 and 20 are an exploded perspective view and a coupled transverse cross-sectional view illustrating an example of a space portion in the compressor according to FIG. 3.
Figure 20:
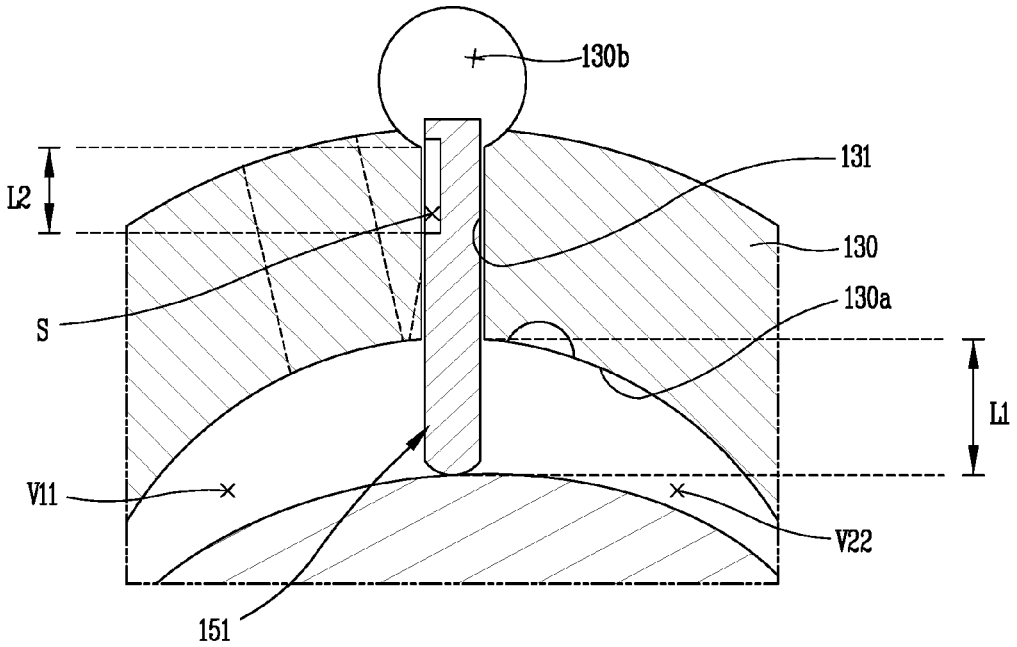
Figure 21:
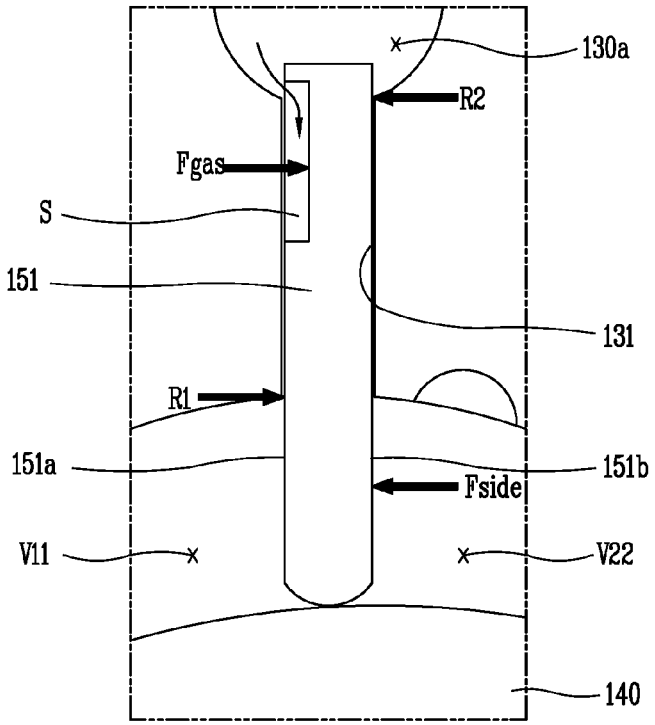
FIG. 21 is a schematic view illustrating the relationship of forces applied to a vane in the compressor according to FIG. 20.
Figure 22:
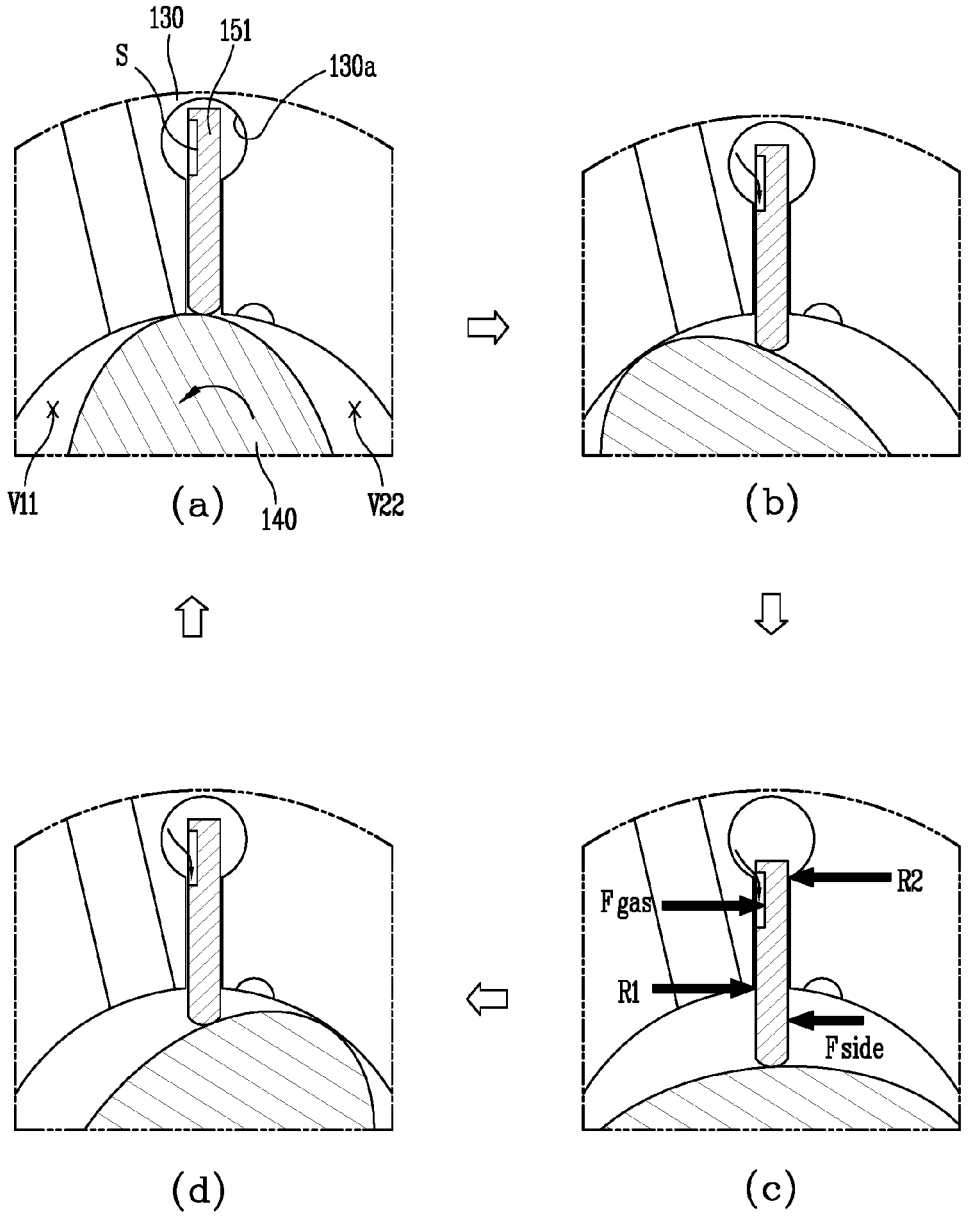
FIG. 22 is a transverse cross-sectional view for explaining the relationship of forces applied to the vane according to a rotation angle of a roller in the compressor according to FIG. 20.

FIGS. 19 and 20 are an exploded perspective view and a coupled transverse cross-sectional view illustrating an example of a space portion in the compressor according to FIG. 3, and FIG. 21 is a schematic view illustrating the relationship of forces applied to a vane in the compressor according to FIG. 20, and FIG. 22 is a transverse cross-sectional view for explaining the relationship of forces applied to the vane according to a rotation angle of a roller in the compressor according to FIG. 20.

As illustrated in FIGS. 19 through 21, a space portion (S) according to the present embodiment may be formed on a first side surface 151*a* corresponding to a suction chamber between both side surfaces of the first vane 151.

Furthermore, the space portion (S) may be formed to have a predetermined area and depth at the center of the first side surface 151*a*. However, the space portion (S) may be preferably formed to have an opposite side (rear end) length of the roller to the extent capable of communicating with an inner space of the casing 10 even when a time point, namely, a rotation angle of the roller 140, at which the first vane 151 is protruded to the maximum is 90 degrees. As a result, an inner portion of the space portion may be communicated with an inner space of the casing in which an inner portion of the space portion is a high pressure region at a time point of receiving the largest side directional gas force (Fside) from the compression chamber by the vane, thereby forming a counterforce (Fgas) in an opposite direction to the side directional gas force (Fside) to that extent.

Furthermore, the space portion (S) may preferably formed to have a length to the extent in which a roller side front end does not communicate with the suction chamber (V11), in particular, not to expose a roller side front end thereof to the suction chamber (V11) at a maximum protrusion time point of the first vane (a time point in which a rotation angle of the roller is 90°). As a result, an inner space of the space portion may be suppressed from being communicated with a suction chamber at a time point in which the vane receives the largest gas force from the compression chamber, thereby forming a counterforce (Fgas) in an opposite direction to the side directional gas force (Fside).

Here, the space portion (S) may be formed to vary in proportion to a protrusion length (L1) of the first vane 151. In other words, a scope of substantially forming a counterforce (Fgas) in the space portion (S) is a region (a shaded area in FIGS. 21 and 22, hereinafter, a side pressure region) (S1) covered by the first vane slot 131. The side pressure region (S1) corresponds to a region of generating a substantial counterforce (Fgas). Accordingly, a length (L2) of the shaded counterforce region (S1) may increase or decrease in proportion to the protrusion length (L1) of the first vane 151 exposed to the compression chamber (V22) by the vane 151 during the movement of the vane. For example, a substantial length (L2) of the counterforce region may be preferably formed to be the same as the protrusion length (L1) of the vane.

Furthermore, the space portion (S) may be formed in the middle of a height direction of the vane. As a result, a bearing surface 151*c* facing an inner wall surface of the vane slot 131 may be formed at either one of both a top and a bottom side of the space portion (S).

The working effects of the foregoing rotary compressor according to the present embodiment will be described as follows.

In other words, as illustrated in FIG. 22A, when a time point in which a major directional end of the roller 140 is brought into contact with the center point of the first vane 151 is 0°, a front end of the first vane 151 is inserted into the first vane slot 131 in a state of being brought into contact with an outer circumferential surface of the roller 140 if a rotation angle of the roller 140 is 0°. Here, most of the space portion (S) is in a state of being exposed to a through hole 130*b* of the cylinder.

Then, when the roller 140 starts rotation in a counterclockwise direction as illustrated in FIG. 22B, the first vane 151 starts to protrude from the first vane slot 131 in a state of facing an outer circumferential surface of the roller 140. Here, part of a front side of the space portion (S) is inserted into the first vane slot 131, but a rear side thereof still maintains a state of being exposed to a through hole 130*b* of the cylinder. Accordingly, even when a second side surface 151*b* of a front side of the first vane is exposed to the compression space (V22) to receive a side directional gas force (Fside), it may be cancelled by a counterforce (Fgas) of the space portion (more particularly, a counterforce region (S1)). Furthermore, a first reaction force (R1) applied to a first side surface 151*a* of the first vane on an inner circumferential open surface of the first vane slot 131 and a second reaction force (R2) applied to a second side surface 151*b* of the first vane on an outer circumferential open surface of the first vane slot 131 may be cancelled out, and as a result, forces applied to the first side surface and the second side surface of the first vane may be cancelled or attenuated from each other to significantly reduce a mechanical friction loss between the cylinder and the vane.

Furthermore, as illustrated in FIG. 22C, the first vane 151 is continuously protruded while the roller 140 rotates up to 90° and protruded to the maximum at a rotation angle of the roller 140 of 90°, and as illustrated in FIGS. 22D and 22A, a protrusion amount of the first vane 151 is decreased while the roller 140 rotates up to 180° again and completely inserted into the first vane slot 131. Even at this time, a counterforce (Fgas) generated in the space portion (more particularly, a counterforce region (S1)) may cancel out an opposite counterforce (Fgas) to significantly suppress a friction loss between the cylinder and the vane.

Figure 23:
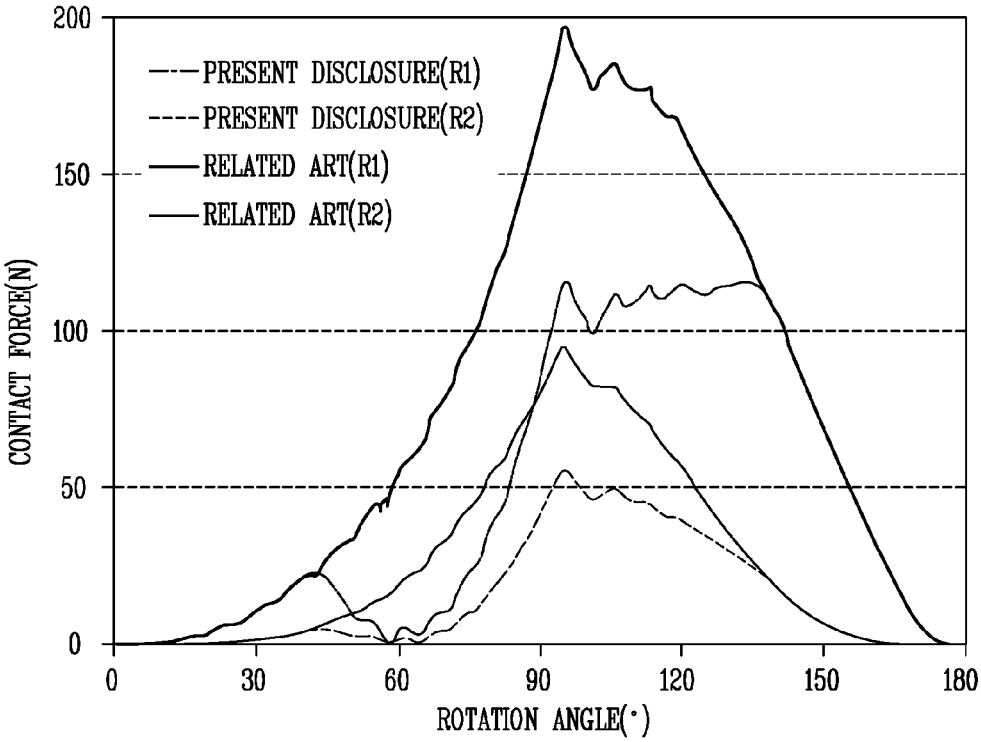
FIG. 23 is a graph illustrating a change of reaction force applied to a front side and a rear side of a vane, respectively.

FIG. 23 is a graph illustrating a change of reaction force applied to a front side and a rear side of the vane, respectively, and as illustrated in the drawing, it is seen that in a case of the present disclosure provided with a space portion, both a first reaction force (R1) and a second reaction force (R2) are significantly reduced compared to a case without the space portion. It may be analyzed that a counterforce (Fgas) formed by the space portion (S) significantly cancels out a side directional gas force (Fside) thereof.

On the other hand, a case of another embodiment for a space portion in a rotary compressor according to the present disclosure will be described as follows. In other words, according to the foregoing embodiment, a space portion is formed in a groove shape at the center of a side surface of the vane, but according to the present embodiment, the space portion is formed at a rear end of a side surface of the vane.

Figure 24:
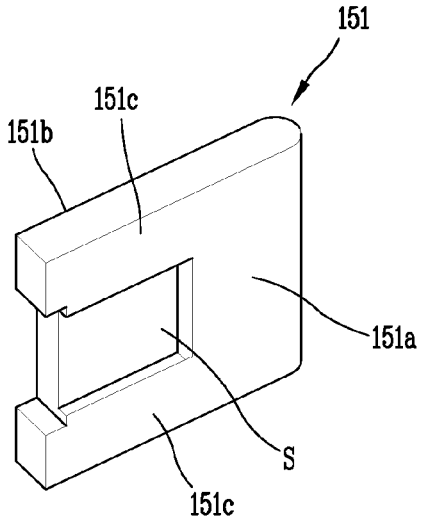
FIG. 24 is a perspective view illustrating another embodiment for the space portion in the compressor according to FIG. 20.
Figure 25:
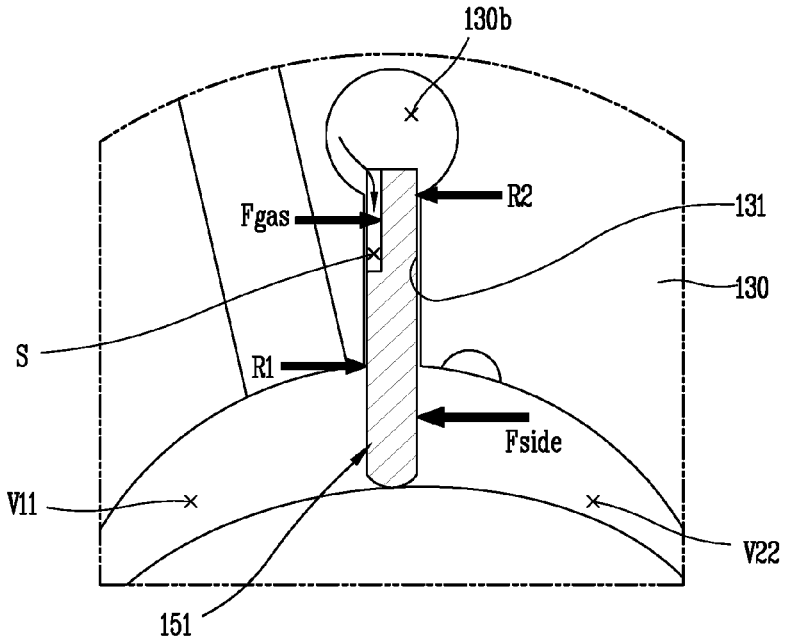
FIG. 25 is a transverse cross-sectional view illustrating a compression section having the space portion according to FIG. 24.

FIG. 24 is a perspective view illustrating another embodiment for the space portion in the compressor according to FIG. 20, and FIG. 25 is a transverse cross-sectional view illustrating a compression section having the space portion according to FIG. 24. Referring to those drawings, a space portion according to the present embodiment may be started from a rear end of the first side surface 151*a* of the first vane 151 and formed in a concave manner by a predetermined length in a front end direction thereof.

Even in this case, a bearing surface 151*c* may be formed at both a top and a bottom side of the space portion (S), respectively. Furthermore, a length (L2) of the space portion (S) may be preferably formed to the extent that a counterforce region (S1), which is a substantial region of the space portion, is proportional to a protrusion length (L1) of the vane as illustrated in the foregoing embodiment.

The basic configuration of the foregoing space portion according to the present embodiment and working effects thereof are substantially the same as the foregoing embodiments and thus the detailed description thereof will be omitted.

On the other hand, a case of another embodiment for a space portion in a rotary compressor according to the present disclosure will be described as follows. In other words, according to the foregoing embodiment, a space portion is formed on a side surface of the vane, but according to the present embodiment, a space portion is formed on a side surface of the vane slot.

Figure 26:
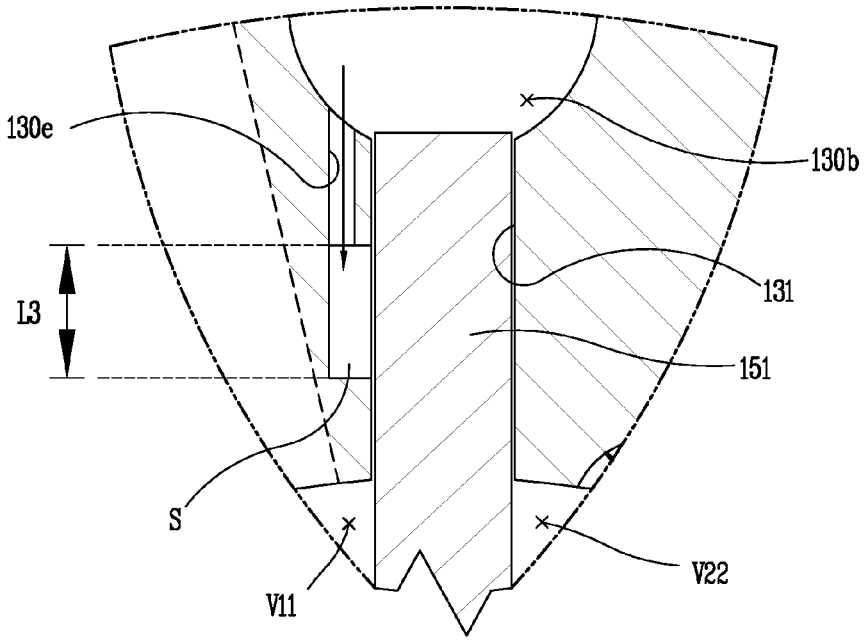
FIGS. 26 and 27 are transverse cross-sectional views illustrating another embodiment for the space portion in the compressor according to FIG. 20.
Figure 27:
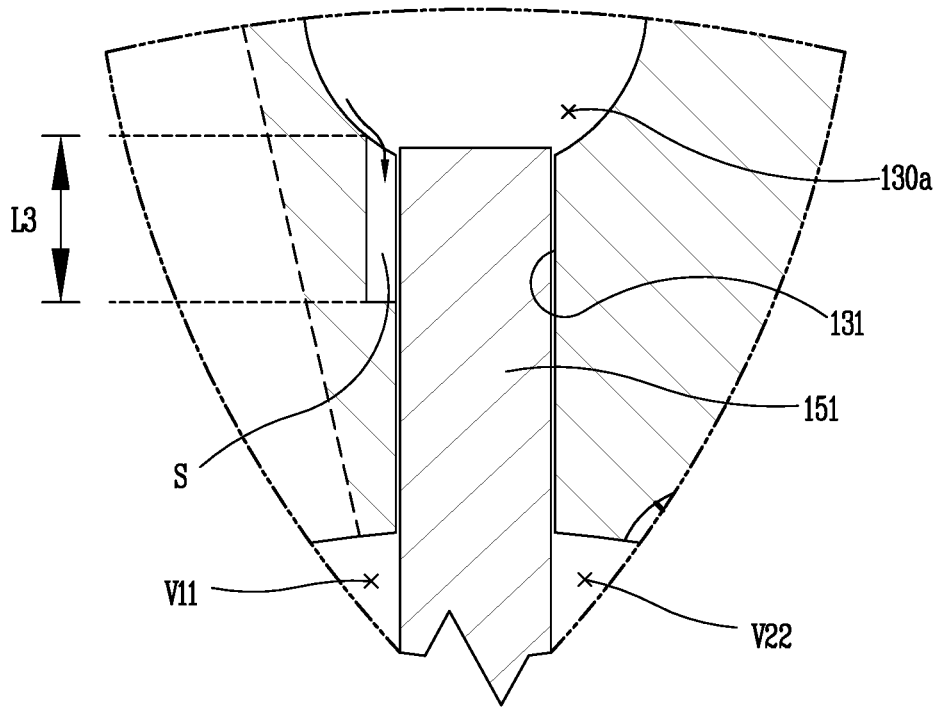

FIGS. 26 and 27 are transverse cross-sectional views illustrating another embodiment for the space portion in the compressor according to FIG. 20. Referring to those drawings, the space portion (S) may be formed in an engraved manner to have a predetermined length and depth in the middle of a side wall surface of the vane slot 131. Furthermore, a gas passage 130*e* may be formed in a hole shape to allow the gas passage 130*e* to communicate between the through hole 130*b* and the space portion (S) of the cylinder 130.

Even in this case, a bearing surface (not shown) may be formed both a top and a bottom of the space portion (S). However, in this case, a length (L3) of the space portion may be fixed, and the length (L3) of the space portion may be preferably formed to correspond to a maximum protrusion length (L1) of the vane. It is because the vane 151 receives the largest side directional gas force (Fside) from the compression chamber (V22) when the vane 151 is protruded to the maximum, and thus in order to appropriately cancel out it, the space portion (S) may be preferably formed to correspond to a maximum protrusion length (L1) of the vane.

Here, as illustrated in FIG. 27, the space portion (S) may be formed in an engraved manner by a predetermined length from the through hole 130*b* of the cylinder toward an inner circumferential open surface thereof. However, in this case, it may be easy in the aspect of processing the space portion (S), but may have a limit in the length of the space portion (S). In other words, if the length of the space portion is too long, then it should be formed in consideration of a front end of the vane being inserted into the space portion, and a design freedom thereof may be relatively decreased to that extent compared to the embodiment on of FIG. 26.

On the other hand, though not shown in the drawing, all the foregoing embodiments may be also applicable in the same manner to a typical rotary compressor with a circular shaped roller. The basic configuration and working effects thereof are substantially the same as the foregoing embodiments and thus the detailed description thereof will be omitted.

However, when the roller is integrally formed into the rotating shaft while a circular roller is applied thereto to remove rotation, it may be possible to enhance a mechanical friction loss by approximately 30% compared to a case where the roller rotates with respect to an outer circumferential surface of the rotating shaft (more particularly, an outer circumferential surface of the eccentric portion).

In other words, when the roller is inserted into the eccentric portion to allow the roller to rotate, a friction loss may occur between the roller and the eccentric portion of the rotating shaft to reduce the compressor efficiency, but when the roller is integrally formed into the rotating shaft as illustrated in the present embodiment, a friction loss between the roller and the rotating shaft may be removed to enhance the compressor efficiency while suppressing a friction loss of the entire compressor.

However, when a circular roller is coupled to the rotating shaft in a condition that a diameter and a height of the cylinder are the same, it may be also possible to increase a reaction force while increasing a contact force between the roller and the vane. Accordingly, when a counterforce corresponding to a side directional gas force increases, a reaction force generated on an inner circumferential open surface and an outer circumferential open surface of the vane slot may be reduced, thereby reducing a friction loss between the cylinder and the vane to that extent.

Figure 28:
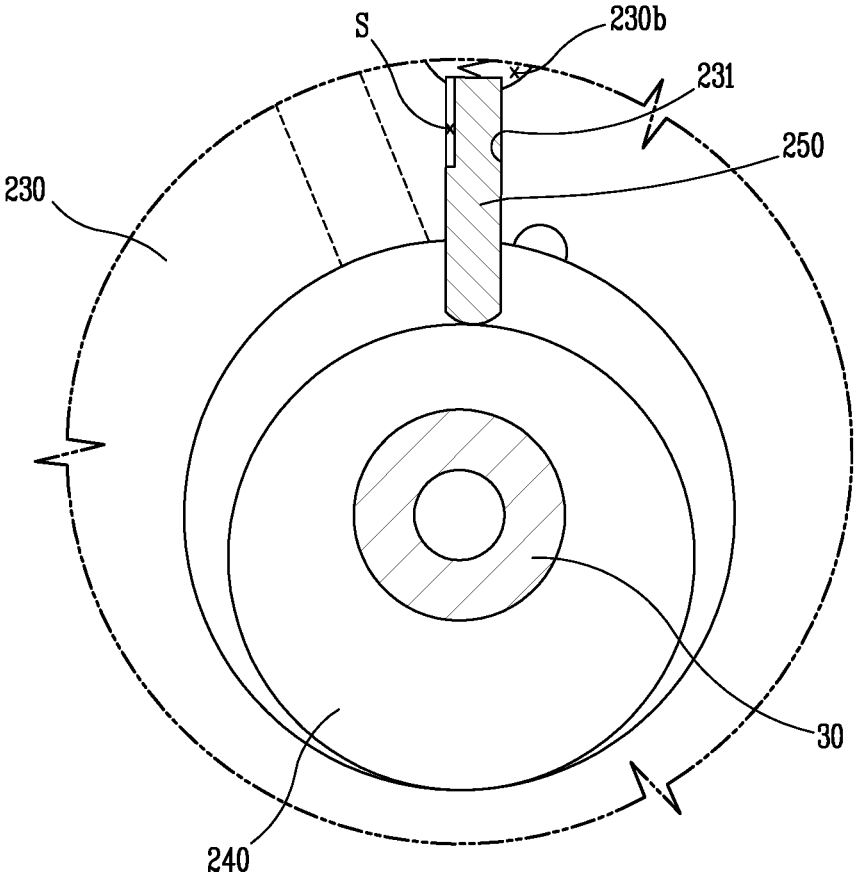
FIG. 28 is a plan view illustrating an embodiment for a shape of a vane when a circular roller is integrally formed into a rotating shaft in a rotary compressor according to the present disclosure.

For example, as illustrated in FIG. 28, a circular roller may be integrally formed into the rotating shaft, and a space portion may be formed on a side surface of the vane brought into contact with an outer circumferential surface of the roller or a suction side inner wall surface of the vane slot facing the side surface of the vane.

Furthermore, the space portion may be communicated with a through hole of the cylinder forming a high discharge pressure to always form a discharge pressure.

As a result, as a counterforce corresponding to a force due to a compression chamber pressure is formed on a substantially the same as of the vane as described above, a reaction force between the vane and the vane slot may be decreased to reduce an entire mechanical friction loss between the cylinder and the vane, thereby enhancing the compressor efficiency.

What is claimed is:

1. A compressor, comprising:

a casing;

a cylinder provided in an inner space of the casing;

a roller configured to concentrically rotate with the cylinder within the cylinder to form at least two or more compression spaces in the cylinder; and two or more vanes configured to face an outer circumferential surface of the roller to be slidably coupled to the cylinder to partition the two or more compression spaces into a suction chamber and a compression chamber, respectively, wherein a space in which a volume thereof varies according to a movement of the vane is formed between one side surface of the vane and the cylinder corresponding thereto, wherein a slot side step stepped by a predetermined length in an outer circumferential side from an inner circumferential end of the vane slot is formed on a side surface of the vane slot, and a vane side step stepped in an opposite direction to the slot side step is formed on a side surface of the vane corresponding to the slot side step, wherein a vane side communication groove is formed on the side surface of the vane, and a slot side communication groove is formed in the cylinder to selectively provide communication between the vane side communication groove and the space according to the movement of the vane, wherein a vane side sealing portion that faces the vane slot to secure a sealing area is formed at a front side of the vane side step, and the vane side communication groove is formed on the vane side sealing portion, and wherein the slot side communication groove Us formed within the slot side step.

2. The compressor of claim 1, wherein the space communicates with the suction chamber or with the inner space of the casing.

3. The compressor of claim 1, wherein the vane side communication groove is formed at at least either one edge of both a top and a bottom edge of the vane side sealing portion, and wherein the slot side communication groove is formed at at least either one edge of both a top and a bottom edge of the slot side step.

4. A compressor, comprising:

a drive motor;

a rotational shaft configured to transfer a rational force of the drive motor;

a cylinder provided at one side of the drive motor;

a roller provided on the rotational shaft to rotate therewith, and allow at least two or more portions of an outer circumferential surface thereof to face an inner circumferential surface of the cylinder to form at least two compression spaces in the cylinder; and at least two or more vanes configured to face the outer circumferential surface of the roller to partition the two or more compression spaces into a suction chamber and a compression chamber, respectively, wherein at least two or more vane slots having an inner surface are formed in the cylinder to face both side surfaces of the vane, wherein a space recessed by a predetermined depth is formed between the vane slot and a side surface of the vane corresponding thereto, wherein a slot side step stepped by a predetermined length in an outer circumferential side from an inner circumferential end of the vane slot is from on a side surface of the vane slot, and a vane side step stepped in and opposite direction to the slot side step in formed on the side surface of the vane corresponding to the slot side step, and wherein the space is located within a radial range of the vane slot and a volume of the space varies according to a movement of the vane.

5. The compressor of claim 4, wherein the space in which the volume thereof varies according to the movement of the vane is formed between the slot side step and the vane side step.

6. The compressor of claim 5, wherein a communication passage by which the space and the suction chamber communicate is formed in the cylinder.

7. The compressor of claim 5, wherein a communication passage by which the space and the suction chamber communicate is formed in the cylinder and the vane, respectively.

8. The compressor of claim 7, wherein the communication passage is configured to block communication between the suction chamber and the space at a portion having a lowest linear velocity, but provide communication between the suction chamber and the space at a portion having a highest linear velocity between the roller and the vane.

9. The compressor of claim 7, wherein the communication passage comprises:

a vane side communication groove formed on a side surface of the vane; and a slot side communication groove formed in the cylinder to selectively communicate between the vane side communication groove and the space according to the movement of the vane.

10. The compressor of claim 9, wherein a vane side sealing portion that faces the vane slot to secure a sealing area is formed at a front side of the vane side step, and the vane side communication groove is formed on the vane side sealing portion, and wherein the slot side communication groove is formed within the slot side step.

11. The compressor of claim 10, wherein the vane side communication groove is formed at at least either one edge of both a top and a bottom edge of the vane side sealing portion, and wherein the slot side communication groove is formed at at least either one edge of both a top and a bottom edge of the slot side step.

12. The compressor of claim 4, wherein the space having a predetermined volume is formed on the side surface of the vane or a side surface of the cylinder corresponding thereto.

13. The compressor of claim 4, wherein the vane comprises:

a vane body; and a vane protrusion convexly formed at a front end of the vane body, and wherein a center of a curvature radius of the vane protrusion is eccentrically formed with respect to a length directional center line of the vane body.

14. The compressor of claim 4, wherein an outer circumferential cross-sectional area of the vane slot is formed to be smaller than an inner circumferential cross-sectional area thereof.

15. The compressor of claim 4, wherein an outer circumferential cross-sectional area of the vane is formed to be smaller than an inner circumferential cross-sectional area thereof.

16. The compressor of claim 4, wherein the space is blocked from the suction chamber at a time point at which a protrusion amount of the vane is highest to form an intermediate pressure chamber.

17. The compressor of claim 4, wherein an outer circumferential end portion of the space communicates with an inner space of the casing in a state in which the vane protrudes to a maximum in a compression space.

* * * * *